US007866508B2

(12) United States Patent
Feldman et al.

(10) Patent No.: US 7,866,508 B2
(45) Date of Patent: Jan. 11, 2011

(54) BEVERAGE DISPENSING SYSTEM AND METHOD

(75) Inventors: Marjorie E. Feldman, Springfield, MA (US); Randolph J. Higgins, Somers, CT (US); David L. Mathieu, Colchester, CT (US); James T. Sener, Glastonbury, CT (US); Christopher D. Hageman, Glastonbury, CT (US); Joseph M. Paul, Thomaston, CT (US); James Fitzgerald, Springfield, MA (US)

(73) Assignee: JMF Group LLC, East Windsor, CT (US)

( * ) Notice: Subject to any disclaimer, the term of this patent is extended or adjusted under 35 U.S.C. 154(b) by 812 days.

(21) Appl. No.: 11/230,311

(22) Filed: Sep. 19, 2005

(65) Prior Publication Data

US 2007/0062972 A1 Mar. 22, 2007

(51) Int. Cl.
*B67D 7/74* (2010.01)

(52) U.S. Cl. ..... 222/129.2; 222/129.1; 222/146.6

(58) Field of Classification Search ..... 222/80–83, 222/90, 129.1, 144.5, 129.2, 146.6, 394, 222/399, 400.7, 400.8; 141/9
See application file for complete search history.

(56) References Cited

U.S. PATENT DOCUMENTS

| | | | | |
|---|---|---|---|---|
| 1,248,705 | A | 12/1917 | Pogue | |
| 1,334,523 | A | 3/1920 | Cornish | |
| 1,347,576 | A | 7/1920 | Cornish | |
| 3,326,417 | A | 6/1967 | Tinsley | |
| 3,938,639 | A | 2/1976 | Birrell | |
| 4,042,151 | A | 8/1977 | Uttech | |
| 4,440,318 | A | 4/1984 | Berger | |
| 4,470,999 | A * | 9/1984 | Carpiac | 426/506 |
| 4,493,441 | A | 1/1985 | Sedam et al. | |
| 4,496,080 | A | 1/1985 | Farber et al. | |
| 4,520,950 | A | 6/1985 | Jeans | |
| 4,597,509 | A | 7/1986 | Pereira | |
| 4,635,824 | A | 1/1987 | Gaunt et al. | |
| 4,651,862 | A | 3/1987 | Greenfield | |
| 4,874,023 | A | 10/1989 | Ulm | |
| 4,932,561 | A | 6/1990 | Boxall | |
| 4,938,387 | A | 7/1990 | Kervefors et al. | |

(Continued)

OTHER PUBLICATIONS

PCT/US2006/036672 International Search Report and Written Opinion dated Apr. 3, 2008.

*Primary Examiner*—Kevin P Shaver
*Assistant Examiner*—Robert K Nichols, II
(74) *Attorney, Agent, or Firm*—Michael Best & Friedrich LLP

(57) ABSTRACT

A beverage dispensing system and method for dispensing a beverage comprising water from a water source. Some embodiments of the beverage system can include a housing, an inlet adapted to be coupled to the water source, a concentrate source containing concentrate, a dispensing outlet, a fluid line, and a valve. The dispensing outlet can dispense at least one of water and the concentrate. The fluid line can fluidly couple the water source and the dispensing outlet. The valve can be positioned to supply any desired amount of concentrate in a range of concentrate amounts from the concentrate source to the fluid line. The range of concentrate amounts can correspond to a range of water amounts flowing through the fluid line to produce a corresponding range of beverage amounts dispensed from the dispensing outlet.

27 Claims, 16 Drawing Sheets

U.S. PATENT DOCUMENTS 4,940,164 A 7/1990 Hancock
4,986,448 A 1/1991 Takahashi et al.
4,991,635 A 2/1991 Ulm
5,031,676 A 7/1991 Ulm
5,097,989 A 3/1992 Nakayama et al.
5,105,982 A 4/1992 Takahashi et al.
5,172,831 A 12/1992 Burrows
5,222,531 A 6/1993 Baker et al.
D338,705 S 8/1993 Spokoiny
5,232,125 A 8/1993 Adams
5,273,083 A 12/1993 Burrows
5,289,855 A 3/1994 Baker et al.
5,295,519 A 3/1994 Baker et al.
5,314,098 A 5/1994 Milenkevich
5,316,187 A 5/1994 Drobish et al.
5,323,832 A 6/1994 Burrows
5,328,059 A 7/1994 Campbell
5,337,784 A * 8/1994 Grubb ..... 137/625.38
5,348,192 A 9/1994 Sardynski et al.
5,351,859 A * 10/1994 Jansen ..... 222/82
5,390,805 A 2/1995 Bilani et al.
5,413,152 A 5/1995 Burrows
5,425,404 A 6/1995 Dyer
5,439,178 A 8/1995 Peterson
5,462,208 A 10/1995 Stahley et al.
5,476,195 A 12/1995 Oder et al.
5,492,250 A 2/1996 Sardynski
5,499,741 A 3/1996 Scott et al.
5,542,555 A 8/1996 Hidding et al.
5,647,416 A 7/1997 Desrosiers et al.
5,653,270 A 8/1997 Burrows
5,664,703 A 9/1997 Reifenberger et al.
5,676,278 A 10/1997 Beyer et al.
5,829,640 A 11/1998 Hershey et al.
5,842,504 A 12/1998 Schennum et al.
5,842,682 A 12/1998 Schennum et al.
5,888,006 A 3/1999 Ping et al.
5,947,340 A 9/1999 Arnold et al.
5,960,508 A 10/1999 Holt et al.
5,988,920 A 11/1999 Kunkler et al.
5,992,685 A * 11/1999 Credle, Jr. ..... 222/1
6,003,191 A 12/1999 Sherry et al.
D420,561 S 2/2000 Kunkler
6,048,123 A 4/2000 Holt et al.
6,050,457 A 4/2000 Arnold et al.
6,073,539 A 6/2000 Triola et al.
6,101,661 A 8/2000 Policicchio et al.
6,142,750 A 11/2000 Benecke
6,193,113 B1 2/2001 Hidding
6,206,058 B1 3/2001 Nagel et al.
6,269,837 B1 8/2001 Arent et al.
6,328,543 B1 12/2001 Benecke
6,427,730 B2 8/2002 Nagel et al.
6,471,095 B1 10/2002 Cann
6,491,069 B2 12/2002 Nagel et al.
6,554,165 B2 * 4/2003 Cote ..... 222/129.1
6,612,344 B2 9/2003 Nagel et al.
6,619,511 B2 9/2003 Hydak et al.
6,648,180 B2 11/2003 Moon et al.
6,726,062 B2 4/2004 Segiet
6,732,885 B2 * 5/2004 Mathues ..... 222/1
6,758,165 B2 7/2004 Pappas et al.
6,868,988 B2 3/2005 Ufheil et al.
6,994,231 B2 * 2/2006 Jones ..... 222/129.1
7,048,148 B2 * 5/2006 Roekens et al. ..... 222/129.2
7,147,131 B2 * 12/2006 Sher et al. ..... 222/1
2002/0130140 A1 9/2002 Code
2002/0170925 A1 * 11/2002 Friedman ..... 222/129.1
2002/0175127 A1 11/2002 Crowley et al.
2003/0056841 A1 3/2003 Dalhart et al.
2003/0094213 A1 5/2003 Moon et al.
2003/0102330 A1 6/2003 Cote
2003/0230597 A1 * 12/2003 Naik ..... 222/129.1
2003/0233986 A1 12/2003 Pappas et al.
2004/0020723 A1 * 2/2004 Schuman et al. ..... 186/52
2004/0112917 A1 6/2004 Groesbeck
2004/0129723 A1 7/2004 Meder et al.
2005/0067434 A1 3/2005 Yu
2005/0077320 A1 4/2005 Choi et al.
2006/0000851 A1 * 1/2006 Girard et al. ..... 222/129.1
2006/0113323 A1 * 6/2006 Jones ..... 222/129.1

* cited by examiner

BEVERAGE DISPENSING SYSTEM AND METHOD

BACKGROUND

As is well known in the beverage dispensing art, many conventional beverage dispensers dispense water from a water jug connected to a housing. The water may be pumped from the water jug to a spout for dispensing, or may be gravity fed to the spout. Some conventional dispensers include a refrigeration system to cool the water prior to dispensing.

Water or other comestible fluid dispensed from some conventional dispensers can be treated in one or more manners. For example, water or other comestible fluid can be mixed with oxygen or carbon dioxide to produce an oxygenated or carbonated beverage, respectively. Some dispensers allow a concentrate, such as a juice or coffee concentrate to be mixed with water prior to being dispensed. For example, some dispensers include a concentrate container positioned at a location remote from the dispenser. Substantial tubing and an unobstructed path for such tubing is required to connect the concentrate container to the dispenser. In these and other cases, a concentrate container can be positioned above the level of a spout for dispensing, wherein the concentrate is directed toward the spout by gravity. Other dispensers include a concentrate container positioned below the level of the spout, wherein the concentrate is pumped from the container upwardly toward the spout or a mixing tube where the concentrate is mixed with water. Some beverage dispensers that mix a concentrate with water inject a set amount of concentrate into a stream of water having a known volume, and only allow discrete volumes of beverage to be dispensed. In such cases, the user is not able to control the volume of beverage to be dispensed.

SUMMARY

Some embodiments of the present invention provide a beverage dispensing system for dispensing a beverage comprising water from a water source, wherein the beverage dispensing system comprises a housing; an inlet adapted to be coupled to the water source; a concentrate source removably positioned within a storage receptacle of the housing and adapted to contain concentrate; a dispensing outlet from which at least one of water and concentrate is dispensed from the beverage dispensing system; a fluid line fluidly coupling the water source and the dispensing outlet; a pump fluidly coupled to the fluid line to move water at a volumetric flow rate from the water source to the dispensing outlet via the fluid line; and a valve positioned to supply an amount of concentrate from the concentrate source to the fluid line corresponding to the volumetric flow rate of the water in the fluid line and the desired concentration of concentrate in the beverage to be dispensed, the concentrate being moved into the fluid line by operation of the pump.

In some embodiments of the present invention, a beverage dispensing system for dispensing a beverage comprising water from a water source is provided, and comprises a housing; an inlet adapted to be coupled to the water source to supply water at a volumetric flow rate; a portable and removable concentrate source adapted to retain concentrate to be dispensed by the beverage dispensing system; a dispensing outlet from which at least one of water and concentrate is dispensed from the beverage dispensing system; a fluid line fluidly coupling the water source and the dispensing outlet; and a valve positioned to supply any desired amount of concentrate in a range of concentrate amounts from the concentrate source to the fluid line, wherein the range of concentrate amounts correspond to a range of water amounts flowing through the first fluid line to produce a corresponding range of beverage amounts dispensed from the dispensing outlet.

Some embodiments of the present invention provide a method for dispensing a beverage, wherein the method comprises providing a water source for supplying water; providing a concentrate source for supplying concentrate; moving water from the water source toward a dispensing outlet via a fluid line by a pump in fluid communication with the fluid line, the pump moving the water at a volumetric flow rate; and moving concentrate from the concentrate source to the fluid line by the pump via a valve, the valve positioned to supply an amount of concentrate to the fluid line based on the volumetric flow rate of the water in the fluid line and the desired concentration of concentrate in the beverage to be dispensed.

Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Also, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

As used herein and in the appended claims, the term "comestible material" generally refers to any type of food or drink intended to be consumed. Specifically, the term "comestible material" can include comestible fluids or comestible powders. The term "comestible fluid" generally refers to any type of food or drink intended to be consumed and which is found in a flowable form. The term "comestible powder" generally refers to any type of food or drink intended to be consumed and which is found in a solid (i.e., non-liquid) form. It should be noted that the terms "comestible fluid" and "comestible powder" are not mutually exclusive. For example, a comestible powder can be found in a flowable form.

As used herein and in the appended claims, the term "concentrate" generally refers to a comestible material (e.g., a comestible fluid or comestible powder) that can be combined with water to form a beverage. The term "concentrate" does not indicate or imply a specific concentration or density, but instead merely refers to a comestible material that is concentrated relative to the resulting beverage that is formed after the concentrate is combined with water. In some embodiments, the concentrate may be only slightly diluted with water. The resulting beverage formed by combining the concentrate with water may have any desired concentration of concentrate (e.g., 1% concentrate, 10% concentrate, 98% concentrate, and the like).

Figure 1:
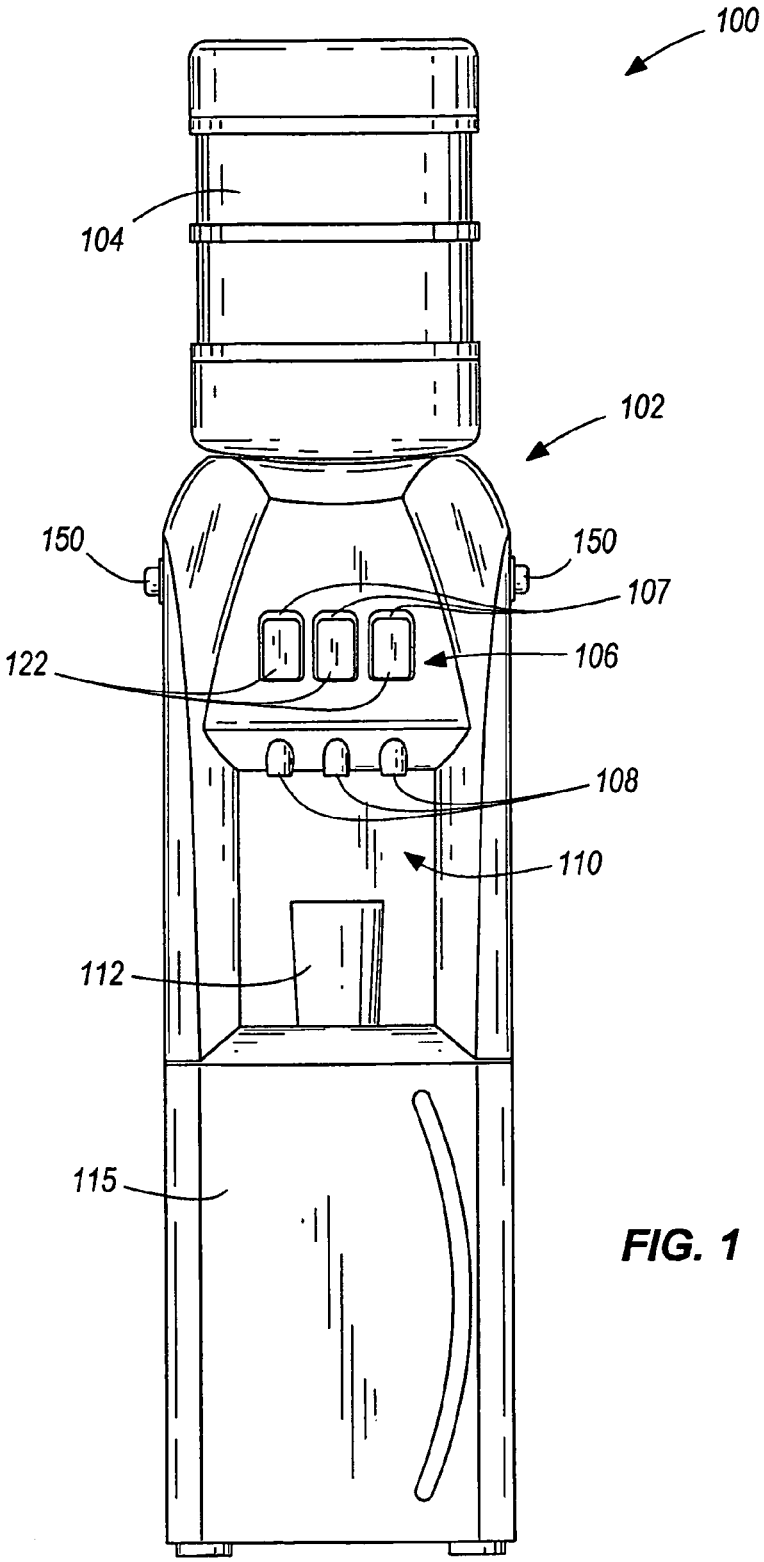
FIG. 1 is a front view of a beverage dispensing system according to an embodiment of the present invention.
Figure 2:
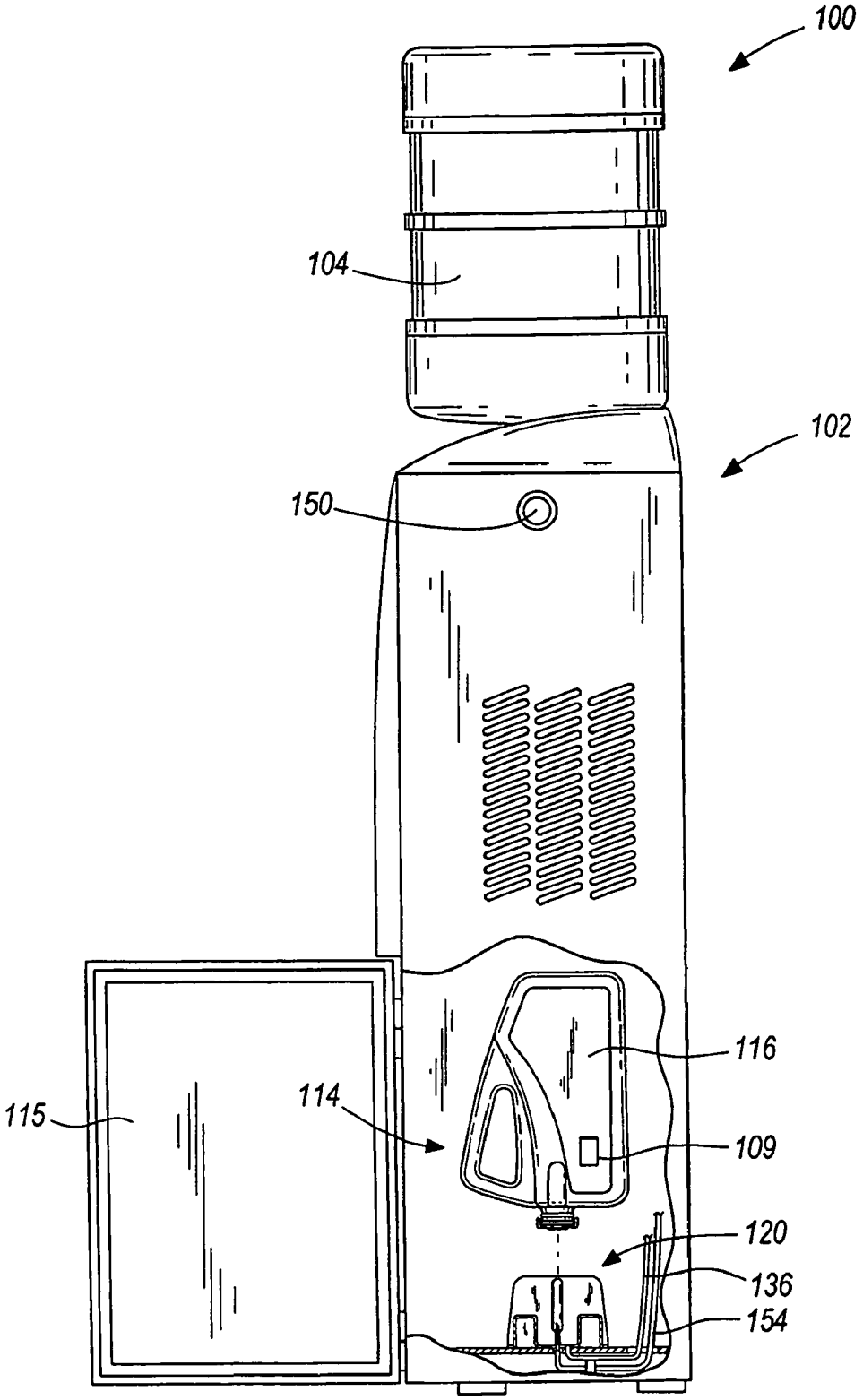
FIG. 2 is a side view of the beverage dispensing system of FIG. 1, shown with a door of the beverage dispensing system in an open position.

FIGS. 1 and 2 illustrate a beverage dispensing system 100 according to an embodiment of the present invention. The illustrated beverage dispensing system 100 includes a housing 102, a water source 104 removably (and, in some embodiments, replaceably) coupled to the housing 102 and adapted to supply water for the beverage dispensing system 100 via an inlet 133 (shown schematically in FIG. 3). The inlet 133 can take any form suitable for connection of the water source 104 to the rest of the beverage dispensing system 100, including a number of such connections well known to those skilled in the art.

The housing 102 in the illustrated embodiment includes a display 106 for displaying beverages available for dispense from the beverage dispensing system 100. The housing 102 has one or more dispensing outlets 108 from which a beverage can be dispensed. The dispensing outlet(s) 108 can be defined by one or more nozzles having any shape, or any other structure configured to allow fluid to pass therethrough to exit the beverage dispensing system 100. The illustrated housing 102 further defines a recess 110 in which a receptacle 112 (e.g., a pitcher, glass, bottle, and the like) can be positioned to collect a beverage dispensed from the dispensing outlets 108. In some embodiments, the housing 102 does not include a recess 110, and can instead include a protrusion in which one or more dispensing outlets are located, and under which a receptacle 112 can be positioned or held. The housing 102 generally houses and supports many of the structural components of the beverage dispensing system 100, and can include any supporting structure or frame suitable for this purpose. The housing 102 can enclose such structural components, and/or can define an enclosure in which one or more concentrate sources 116 (described below) can be housed.

Figure 9:
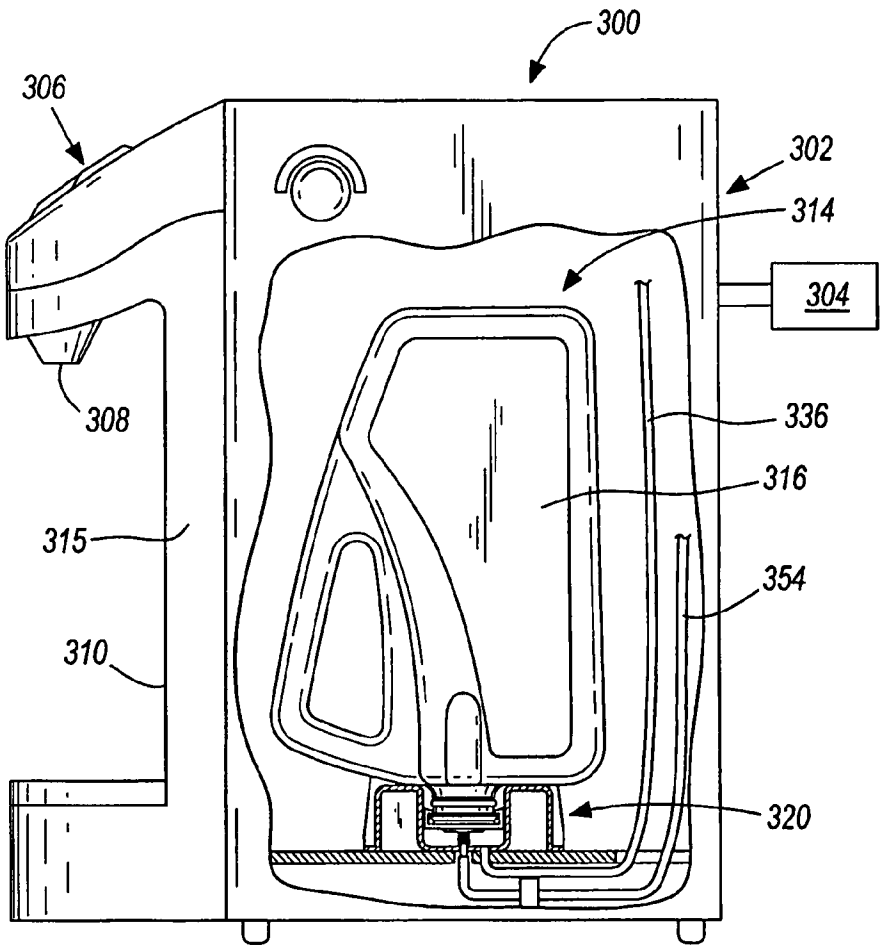
FIG. 9 is a side view of the beverage dispensing system of FIG. 8.
Figure 8:
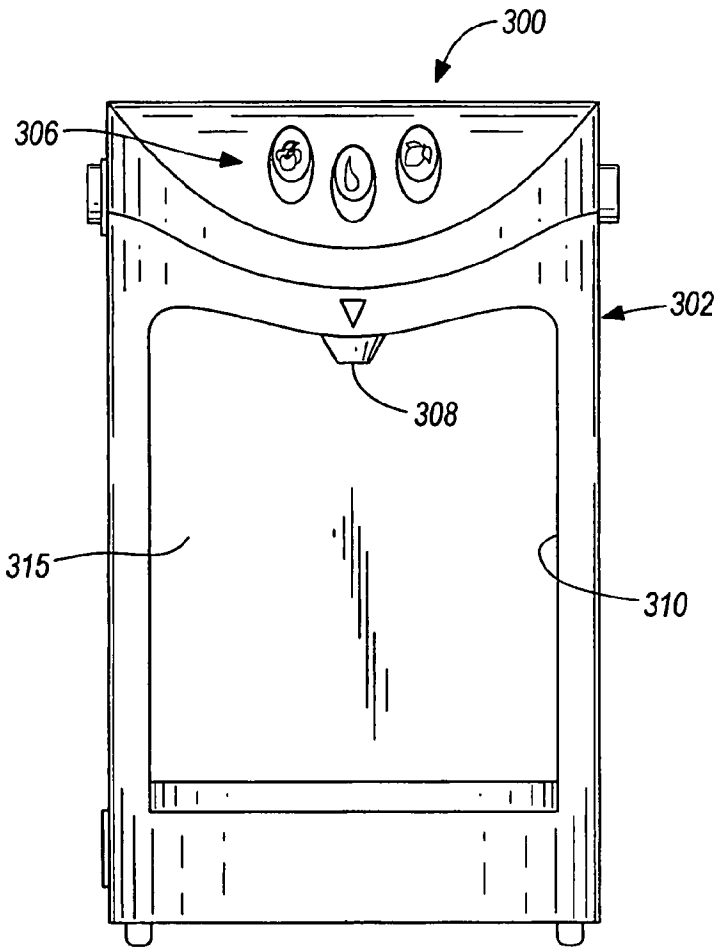
FIG. 8 is a front view of a beverage dispensing system according to another embodiment of the present invention.

In some embodiments, as shown in FIGS. 1 and 2, the water source 104 includes a removable and replaceable container. A variety of sizes of containers having a variety of volumes can be coupled to the housing 102 to supply water. However, in other embodiments, as illustrated in FIGS. 8 and 9 and described below, the water source 104 can include a faucet or other similar tap into a city water supply, or any other suitable external water supply that can be coupled to the housing 102 via standard plumbing fittings and connections known to those of ordinary skill in the art.

As shown in FIG. 2, the illustrated housing 102 further defines a storage receptacle 114 accessible by a door 115 for housing one or more concentrate sources 116. As described in greater detail below, the storage receptacle 114 includes one or more concentrate source installation assemblies 120 for establishing fluid communication between one or more concentrate sources 116 and other components of the beverage dispensing system 100. The concentrate source installation assemblies 120 can also include structure for holding and maintaining the concentrate sources 116 in a proper operating position while maintaining the fluid communication. The details of an embodiment of a concentrate source installation assembly 120 will be described in greater detail below with reference to FIGS. 5 and 6.

In some embodiments, the beverage dispensing system 100 can include multiple concentrate source installation assemblies 120 such that multiple concentrate sources 116 can be simultaneously fluidly coupled to other components of the beverage dispensing system 100. In some embodiments, the beverage dispensing system 100 can include one concentrate source installation assembly 120 such that one concentrate source 116 can be fluidly coupled to other components of the beverage dispensing system 100, and additional replacement concentrate sources 116 can be stored (i.e., not fluidly coupled to other components) within the storage receptacle 114 (e.g., on shelves, in bins, resting on the floor of the storage receptacle 114, and the like) until needed. In some embodiments, at least a portion of the storage receptacle 114 is refrigerated to cool concentrate source(s) 116 in use, concentrate source(s) 116 being stored, or combinations thereof. Refrigeration components of a refrigeration system (not shown) can be housed within the storage receptacle 114, in another portion of the housing 102, or adjacent the beverage dispensing system 100.

As shown in FIG. 1, the display 106 can further include one or more user-manipulatable flow controls 122 for controlling which beverage is to be dispensed from the beverage dispensing system 100, and the volume of beverage to be dispensed, based on signals received from each respective user-manipulatable flow control 122. A number of different user-manipulatable flow controls 122 can be used, including, without limitation, at least one of a pressure-activated button (see FIG. 1), a dial, a switch, a knob, a temperature sensor, an optical sensor, any other suitable user-manipulatable control known to those of ordinary skill in the art, and combinations thereof. As explained in greater detail below, the user-manipulatable flow control 122 can be used to cause a beverage to be dispensed for a period of time corresponding to the activation of the user-manipulatable flow control 122, and accordingly, the signals sent by the user-manipulatable flow control 122. For example, in embodiments in which the user-manipulatable flow control 122 includes a button, the button can be pressed for a period of time corresponding to the time desired to dispense a beverage. Similarly, in embodiments in which the user-manipulatable flow control 122 includes an optical sensor, the beverage dispensing system 100 can be activated to dispense a beverage for a period of time corresponding to a period of time that a receptacle 112 is positioned relative to a dispensing outlet 108, and thus, corresponding to a period of time that the optical sensor senses the presence of the receptacle 112 and sends a signal to other components of the beverage dispensing system 100 to dispense a beverage.

In some embodiments, the display 106 can include one or more beverage identification areas 107 that can be located on or near the user-manipulatable controls 122 to identify the beverages that are available for dispensing from the beverage dispensing system 100. The beverage identification areas 107 can include static (i.e., permanent) or dynamic beverage identifying information to reflect the type of beverage(s) currently available from the beverage dispensing system 100. For example, one or more labels 109 can be coupled to the beverage identification areas 107 of the display 106 in a variety of manners, including but not limited to, pins, screws, and other conventional fasteners, magnets, clips, brackets, and hook and loop fastener material coupling the labels 109 to the display 106, by the labels 109 being received within a sleeve, button, or other device coupled to the display, and the like.

With continued reference to FIGS. 1 and 2, the labels 109 can include stickers that can be removed from the concentrate source 116 and placed in the respective beverage identification areas 107 to identify the types of beverages currently available. For example, a first label 109 can be removed from a first concentrate source 116 and positioned in a beverage identification area 107 of the display 106. When the first concentrate source 116 is replaced by a second concentrate source 116, the first label 109 can be removed from the beverage identification area 107, and a second label 109 can be removed from the second concentrate source 116 and positioned in the beverage identification area 107.

Figure 7:
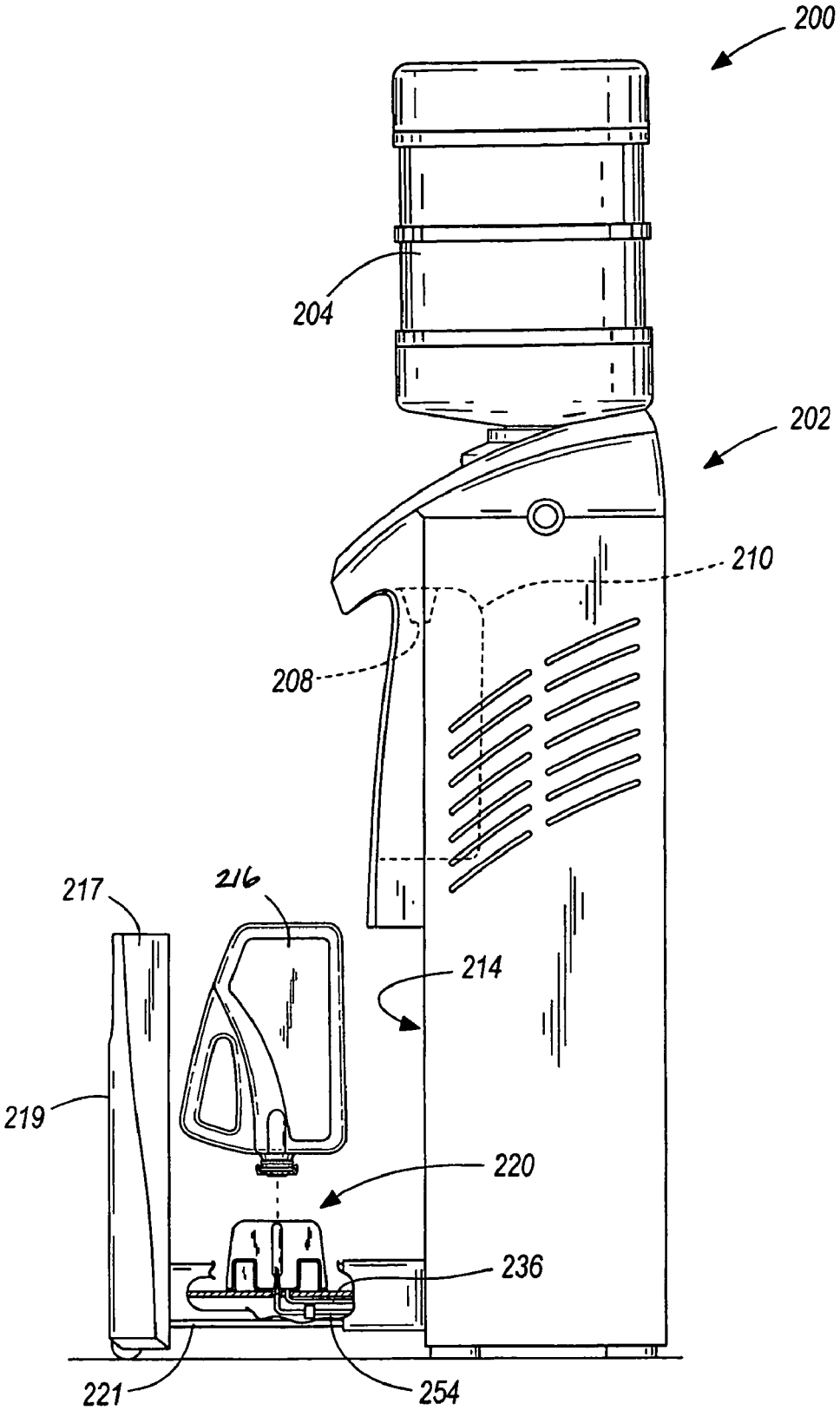
FIG. 7 is a side view of a beverage dispensing system according to another embodiment of the present invention.

As shown in FIG. 1, in some embodiments, the housing has multiple dispensing outlets 108 for dispensing different beverages. In some embodiments, as shown in FIG. 7, the housing has a single dispensing outlet 208 in fluid communication with one or more ports for dispensing one or more beverages, respectively, or combinations thereof.

Figure 3:
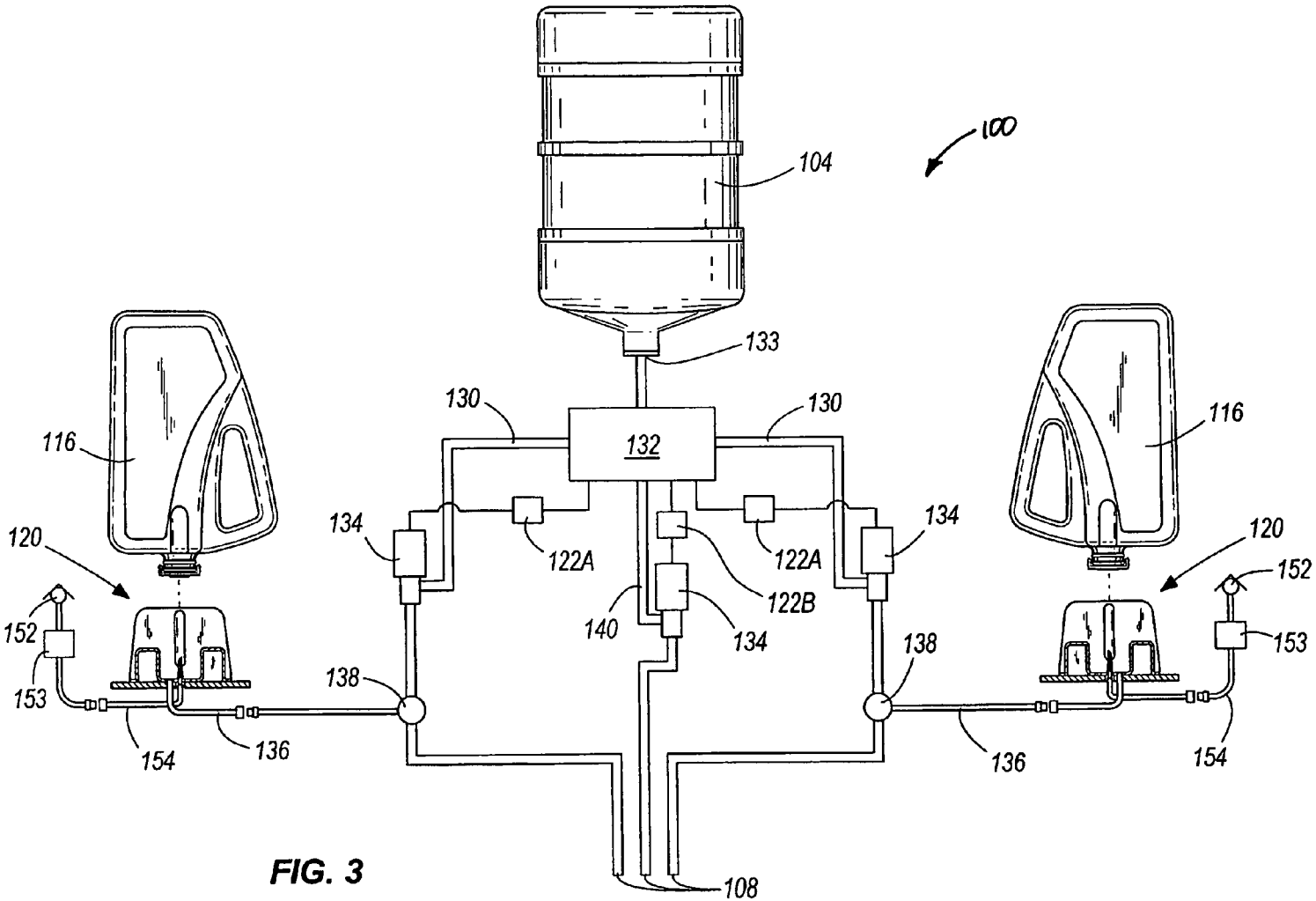
FIG. 3 is a schematic view of the beverage dispensing system of FIGS. 1 and 2.

FIG. 3 illustrates a schematic view of the beverage dispensing system 100 shown in FIGS. 1 and 2. As shown in FIG. 3, the illustrated beverage dispensing system 100 includes, by way of example only, two concentrate sources 116 and associated fluid lines and couplings. Thus, although only one side of FIG. 3 will be described herein, it will be appreciated that the same description can apply to the opposite side of FIG. 3 and to any additional concentrate sources 116 and associated beverage dispensing system components that the beverage dispensing system 100 may include.

FIGS. 1 and 2 show the beverage dispensing system 100 with the water source 104 positioned at a higher elevation (e.g., substantially above) the dispensing outlets 108, and the concentrate sources 116 positioned at a lower elevation (e.g., substantially below) the water source 104 and the dispensing outlets 108. However, the water source 104, concentrate sources 116, and dispensing outlets 108 can have any locations with respect to one another in other embodiments of the present invention. For example, the arrangement of system components illustrated in FIG. 3 can be accomplished by positioning the water source 104, the concentrate sources 116 and the dispensing outlet 108 according to FIGS. 1 and 2, by positioning the concentrate sources 116 above the dispensing outlets 108 and positioning the water source 104 below the dispensing outlets 108, by positioning the concentrate sources 116 and the water source 104 at substantially the same elevation above, at, or below the dispensing outlets 108, and the like. Accordingly, FIG. 3 is a schematic view of the beverage dispensing system 100, and does not alone indicate or imply any particular arrangement of the water source 104, concentrate sources 116, and dispensing outlets 108.

The beverage dispensing system 100 illustrated in FIG. 3 includes a first fluid line 130 that fluidly connects the water source 104 to the dispensing outlets 108. As used herein and in the appended claims, the term "fluid line" refers collectively to those areas through which fluid passes from a source of fluid (e.g., the water source 104) to a destination (e.g., a dispensing outlet 108), and can include any number and combination of pipes, hoses, and other conduits, chambers, receptacles, and the like within or external to other system components. A "fluid line" can refer to the entire path followed by fluid through the system or can refer to a portion of that path.

As used herein and in the appended claims, the terms "upstream" and "downstream" refer to the direction of fluid movement in a beverage dispensing system. That is, the term "upstream" is used to describe any location, element or process that occurs prior to the point or area being referred to relative to the direction of fluid movement in a beverage dispensing system, whereas the term "downstream" is used to describe any location, element or process that occurs subsequent to the point or area of reference with respect to fluid movement in the beverage dispensing system.

With continued reference to FIG. 3, a pump 132 is fluidly coupled to the water source 104 and the first fluid line 130 to move water from the water source 104 toward a dispensing outlet 108 via the first fluid line 130. A dispense control valve 134 is fluidly coupled to the first fluid line 130 to control when water is moved through the first fluid line 130 toward the dispensing outlet 108. A user-manipulatable flow control 122A can be manipulated by a user to activate the pump 132 to a powered-on state, and to directly or indirectly actuate the dispense control valve 134 to allow water to move in the first fluid line 130 at a volumetric flow rate determined by the pump and/or by settings of the pump 132. In some embodiments, a variable pump 132 is employed, and the water can be moved in the first fluid line 130 by the pump at a selectively variable volumetric flow rate.

Figure 4:
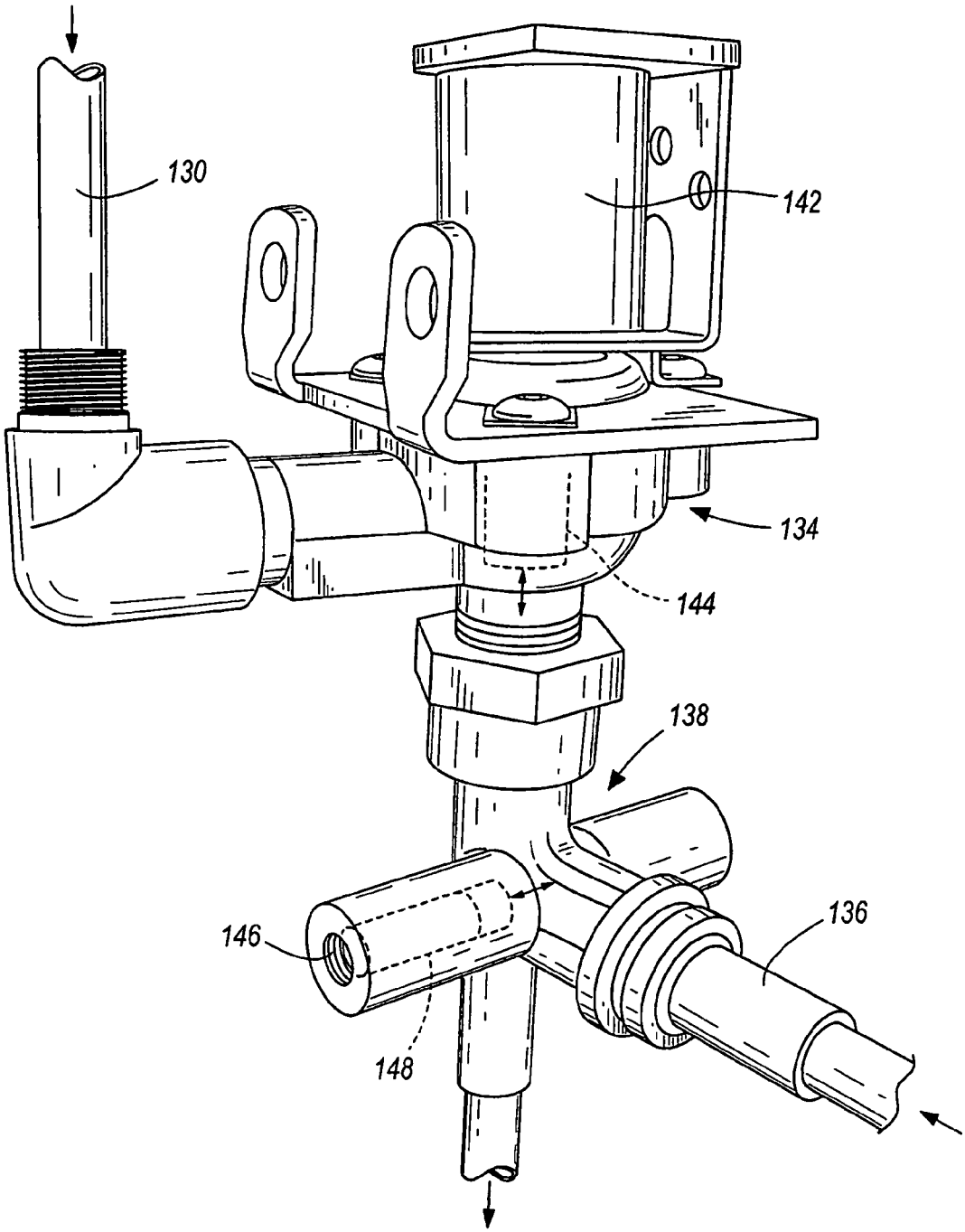
FIG. 4 is a perspective view of components of the beverage dispensing system illustrated in FIG. 3.

In some embodiments, as shown in the detailed view of FIG. 4, the dispense control valve 134 includes a solenoid valve, and manipulating the user-manipulatable flow control 122A causes the pump 132 to power on, and energizes a solenoid to open the dispense control valve 134 to allow water to flow in the first fluid line 130 through the dispense control valve 134. In other embodiments, the dispense control valve 134 includes a valve having a threshold pressure below which fluid does not pass the valve. In such embodiments, the user-manipulatable flow control 122A is electronically coupled to the pump 132, such that manipulation of the user-manipulatable flow control 122A causes the pump to power on, which creates a pressure rise in the first fluid line 130 between the water source 104 and the dispense control valve 134 sufficient for water to pass the dispense control valve 134. In this manner, water can flow in the first fluid line 130 through the dispense control valve 134.

A second fluid line 136 in the illustrated embodiment of FIG. 3 fluidly couples a concentrate source 116 to the first fluid line 130 via a mixing valve 138. Some embodiments do not include a second fluid line 136, in which case the concentrate source 116 can be connected directly to the first fluid line 130 via the mixing valve 138. The mixing valve 138 allows concentrate to flow from the concentrate source 116 via the second fluid line 136, if employed, and into the first fluid line 130 to mix with the water in the first fluid line 136. By mixing concentrate with water in this manner, a beverage of a desired concentration of concentrate can be produced.

In some embodiments, the mixing valve 138 is not adjustable. However, in other embodiments, the mixing valve 138 is adjustable in order to change the amount of concentrate flowing into the first fluid line 130 during dispensing operations. An adjustable mixing valve 138 can be pre-set and inaccessible to a user of the beverage dispensing system 100, or can be user-adjustable to control the concentration of the resulting beverage at any time (e.g., prior to or during dispensing of the beverage from the dispensing outlet 108). In embodiments in which the mixing valve 138 is non-adjustable (e.g., manufactured to a certain configuration and not including parts adjustable to change the ratio of fluids mixed by the fluid mixing valve 138), an additional valve can be positioned within the second fluid line 136, which can be adjusted to control the amount of concentrate that enters the first fluid line 130, and in turn, to control the concentration of the resulting beverage.

In some embodiments, the mixing valve 138 can include a pre-set portion at a junction of the second fluid line 136 and the first fluid line 130, and an adjustable portion positioned in the second fluid line 136. In some embodiments, the both such portions of a mixing valve 138 are adjustable. In those embodiments in which a mixing valve 138 or portion thereof is located upstream of the junction of the first and second fluid lines 130, 136, the mixing valve 138 (or portion thereof) can include a variety of valves such as a 90-degree turn valve or any other suitable valve known to those of ordinary skill in the art capable of adjusting the amount of concentrate that enters the first fluid line 130. Regardless of the location of the mixing valve 138 or adjustable mixing valve portion (i.e., at the junction of the first and second fluid lines 130, 136 or between such junction and the concentrate source 116), the mixing valve 138 can have any suitable adjustment mechanism known to those in the valve art, including a pivotable lever or handle, and slidable gate, and the like.

With continued reference to the illustrated embodiment of FIG. 3, movement of water in the first fluid line 130 through the mixing valve 138 creates a suction that causes concentrate to flow from the concentrate source 116 into the second fluid line 136 and into the first fluid line 130. That is, movement of the water in the first fluid line 130 causes movement of the concentrate to the first fluid line 130. Such movement of the concentrate can be generated by a Venturi effect by using a Venturi mixing valve as will be described below. Therefore, the concentrate need not be separately pumped into the first fluid line 130. As illustrated in FIG. 3, the pump 132 moves the water in the first fluid line 130, and also moves the concentrate from the concentrate source 116 to the first fluid line 130. The mixing valve 138 supplies an amount of concentrate from the concentrate source 116 to the first fluid line 130 that corresponds to the volumetric flow rate of the water in the first fluid line 130 (and through the mixing valve 138) and the desired concentration of concentrate in the beverage to be dispensed. The mixing valve 138 can include a variety of valve types suitable for supplying an amount of concentrate in this manner. One example of a mixing valve 138 that can be used with the present invention is a Venturi mixing valve that follows Venturi principles known to those of ordinary skill in the art to supply concentrate to the first fluid line 130.

In embodiments in which the water source 104 includes an external water supply, the pump 132 may not be required to move the water in the first fluid line 130, and the water may be supplied at a flow rate suitable for use with the beverage dispensing system 100. For example, the flow rate of water supplied by a water source 104 including an external water supply may be sufficient to move concentrate from the concentrate source 116 (via the second fluid line 136, if employed) to the first fluid line 130.

In some embodiments, the beverage dispensing system can be adapted to dispense water without mixture with concentrate. As shown in FIG. 3 by way of example, a third fluid line 140 fluidly couples the water source 104 to a dispensing outlet 108 for dispensing water directly to the dispensing outlet 108 without mixing the water with any concentrate. Thus, the beverage dispensing system 100 dispenses beverages including water alone or in combination with a concentrate. The pump 132 can be fluidly coupled to the third fluid line 140 as illustrated in FIG. 3 to move the water from the water source 104 toward a dispensing outlet 108 via the third fluid line 140. A user-manipulatable flow control 122B can function similarly to the user-manipulatable flow control 122A described above. That is, when the user-manipulatable flow control 122B is manipulated by a user, the user-manipulatable flow control 122B signals the pump 132 to power on to move water in the third fluid line 140. A dispense control valve 134 can be fluidly coupled to the third fluid line 140 in a similar manner as described above with respect to the first fluid line 130, and can include a variety of valve types to control movement of water in the third fluid line 140. For example, a dispense control valve 134 can be actuated to an open position in response to manipulation of the user-manipulatable flow control 122B, as shown in FIG. 3, or by opening when the pressure in the third fluid line 140 between the water source 104 and the dispense control valve 134 exceeds a threshold pressure.

The beverage dispensing system 100 can include as few as one set of a first fluid line 130 and a second fluid line 136, and as many sets of first and second fluid lines 130, 136 (and, optionally, third fluid lines 140) as desired.

In some embodiments of the present invention, at least a portion of one or more of the first, second and third fluid lines 130, 136, and 140 can be cooled to ensure that some or all of the fluid contained therein is chilled when dispensed. FIGS. 3A-3D illustrate examples of various beverage dispensing systems adapted for performing this function. In the illustrated embodiments of FIGS. 3A-3D, the first and third fluid lines 130 and 140 are cooled. However, it should be noted that the manners in which such cooling is accomplished in each embodiment can be employed to cool the second fluid line 136, to cool only the first fluid line 130, only the third fluid line 140, or to cool any combination of the first, second, and third fluid lines 130, 136, 140. In addition, some embodiments of the present invention include various combinations of the embodiments described below and illustrated in FIGS. 3A-3D in order to cool the first, second, and/or third fluid lines 130, 136, 140.

Figure 3A:
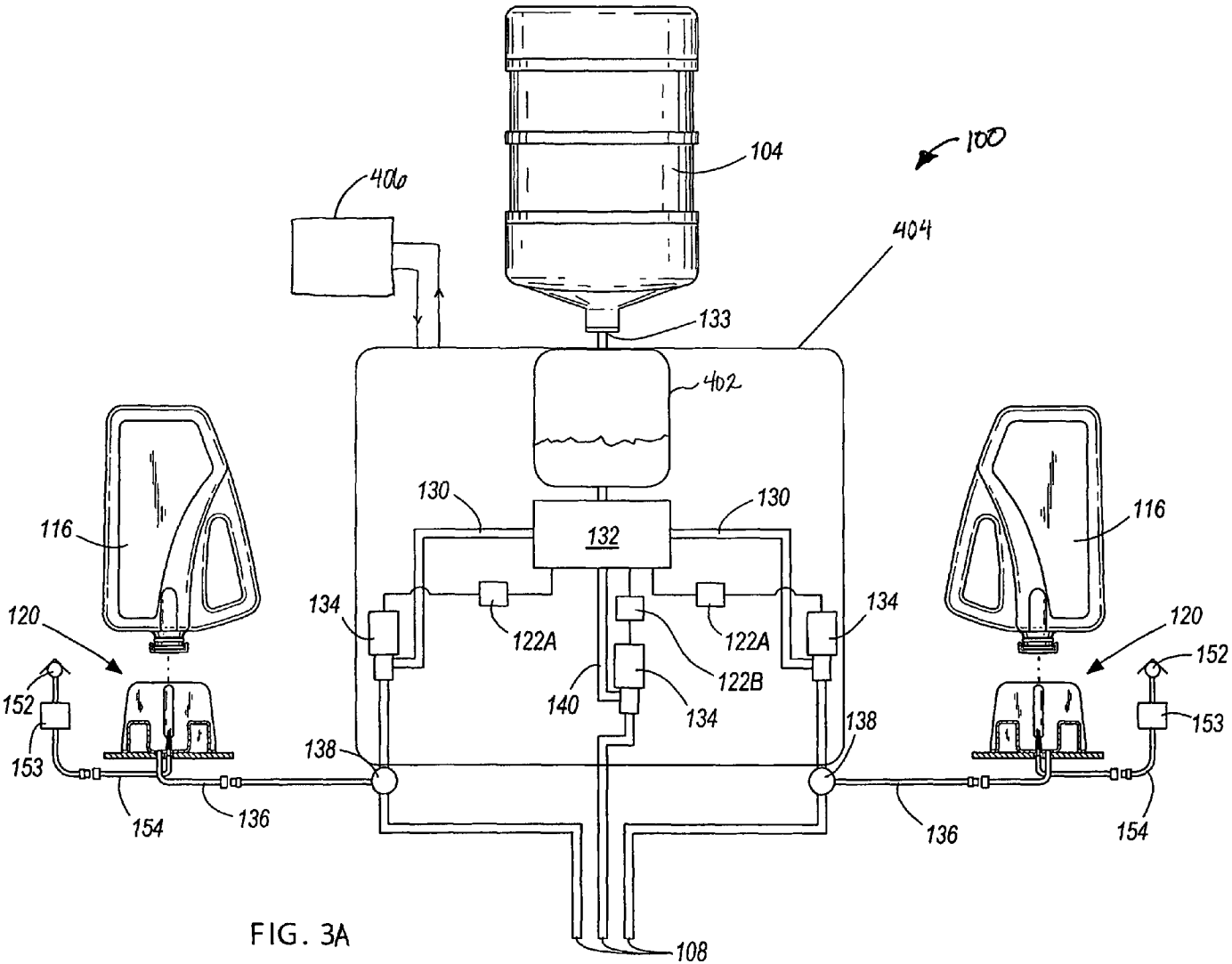
FIG. 3A is schematic view of a beverage dispensing system according to another embodiment of the present invention.

With reference first to FIG. 3A, in some embodiments of the present invention, the beverage dispensing system 100 can include a reservoir 402 in fluid communication with the water source 104 (via the inlet 133) and the pump 132, as shown schematically in FIG. 3A. In addition, in some embodiments, the beverage dispensing system 100 can include a refrigerated compartment 404. The refrigerated compartment 404 can be defined at least partially by the housing 102. As shown schematically in FIG. 3A, the refrigerated compartment 404 can be sized and configured to contain the reservoir 402, the first fluid lines 130, the third fluid line 140, the pump 132, and the dispense control valves 134. The user-manipulatable controls 122A, B can be at least partially contained within the refrigerated compartment 404. In some embodiments, the user-manipulatable controls 122A, B can include electronics and other components that are remote from the refrigerated compartment 404 to substantially avoid the formation of condensate on or adjacent such electronics and other components. In some embodiments, the pump 132 and/or dispense control valves 134 can be at least partially located outside of the refrigerated compartment 404. For example, the pump 132 and/or dispense control valves 134 can have electronics and other components that are remote from the refrigerated compartment 404 to substantially avoid the formation of condensate on or adjacent such electronics and other components.

The refrigerated compartment 404 illustrated in FIG. 3A does not contain the mixing valves 138, the second fluid lines 136, or any portion of the first fluid lines 130 downstream of the mixing valves 138. In such embodiments, the pump 132, control valves 134, mixing valves 138, and/or dispensing outlets 108 can be positioned with respect to one another such that portions of the first and third fluid lines 130 and 140 not contained within the refrigerated compartment 404 (if such portions exist) are relatively short, or as short as structurally possible. In some embodiments, such portions of the first and third fluid lines 130, 140 may be subject to a relatively warm environment. Fluid within these portions of the first and third fluid lines 130, 140 may therefore warm, such as during the time between dispenses of fluid from the beverage dispensing system 100. Therefore, by keeping such portions of the first and third fluid lines 130, 140 relatively short (or as short as structurally possible), the amount of potentially warm fluid within the first and third fluid lines 130, 140 is reduced, minimized or eliminated. In some alternate embodiments, one or more of the mixing valves 138, some or all of the second fluid lines 136, and/or those portions of the first fluid lines 130 downstream of the mixing valves 138 are at least partially contained within the refrigerated compartment 404.

In some embodiments, fluid is not maintained within the first and third fluid lines 130, 140 downstream of the dispense control valves 134 when the beverage dispensing system 100 is not in use, and as a result, the portions of the first and third fluid lines 130, 140 downstream of the dispense control valves 134 need not be contained within the refrigerated compartment 404 to reduce or minimize warm fluid in the first and third fluid lines 130, 140 between dispenses.

As shown schematically in FIG. 3A, the refrigerated compartment 404 is in fluid communication with a refrigeration system 406. The refrigeration system 406 can be any conventional refrigeration system, such as those including an evaporator, a condenser, a compressor, and an expansion valve (not shown). Also, the refrigeration system 406 can refrigerate the refrigerated compartment 404 in a variety of manners, including, but not limited to, convection (i.e., forced air, such as cooled air moved by one or more fans into the refrigerated compartment and/or warmed air moved by one or more fans from the refrigerated compartment), conduction (e.g., by cooling one or more walls or other surfaces at least partially defining the refrigerated compartment 404), and the like, or combinations thereof. The refrigeration system 406 illustrated in FIG. 3A is representative of all such refrigeration systems.

As mentioned above, the storage receptacle 114 (see FIGS. 1 and 2) housing the concentrate sources 116 can also be refrigerated. In some embodiments, the storage receptacle 114 forms a region or portion of the refrigerated compartment 404, or vice versa. In some embodiments, the refrigerated storage receptacle 114 is in fluid communication with the refrigerated compartment 404 and/or the refrigeration system 406 used to refrigerate the refrigerated compartment 404 can also be used to refrigerate the refrigerated storage receptacle 114. In some embodiments, the refrigerated storage receptacle 114 and the refrigerated compartment 400 are not in fluid communication with one another, but the same refrigeration system 406 is used to refrigerate both the refrigerated storage receptacle 114 and the refrigerated compartment 400. Also, in some embodiments, the refrigeration system 406 is responsible for refrigerating the refrigerated compartment 404 alone, and the refrigerated storage receptacle 114 is refrigerated by a separate refrigeration system (not shown).

Figure 3B:
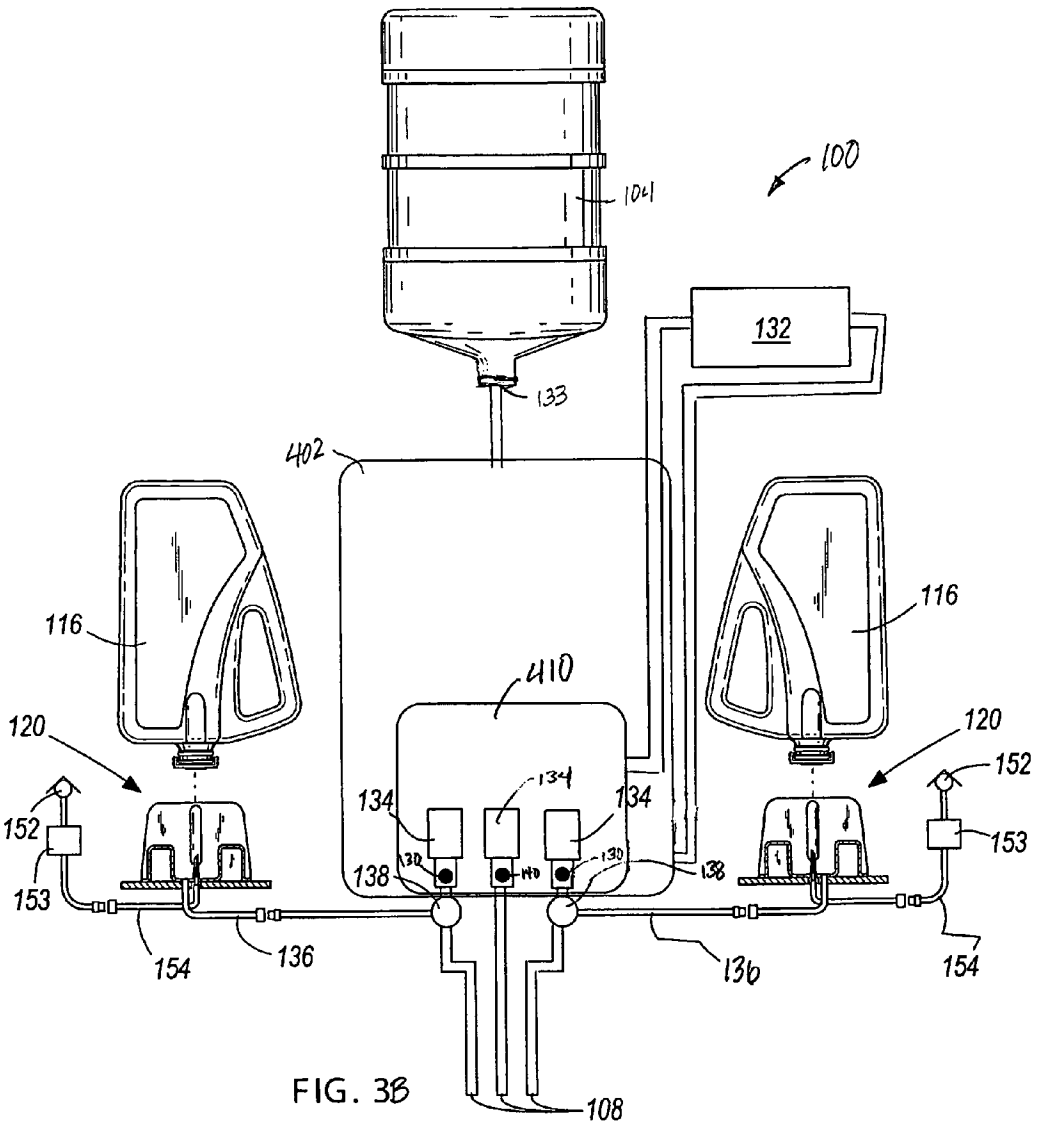
FIG. 3B is schematic view of a beverage dispensing system according to another embodiment of the present invention.

In some embodiments, as shown schematically in FIG. 3B, the beverage dispensing system 100 includes a first reservoir 402, as described above, in fluid communication with the water source 104 for containing water. The first reservoir 402 can be refrigerated or cooled in a variety of manners. By way of example only, the first reservoir 402 can be refrigerated by being at least partially received within a refrigerated compartment (such as the refrigerated compartment 404 described above, or a portion thereof. As another example, the first reservoir 402 can be cooled by a heat exchanger (such as the heat exchanger 420 described below, or a portion thereof). In still other embodiments, the first reservoir 402 can be refrigerated or cooled in any other manner, such as by a refrigerated compartment and a heat exchanger, or by any other refrigeration or cooling devices, and combinations thereof. As shown in FIG. 3B, the first reservoir 402 is fluidly coupled to the pump 132. The pump 132 is also fluidly coupled to a second reservoir 410, which is at least partially housed within the first reservoir 402 such that the second reservoir 410 is also refrigerated and contains cooled water. The first and third fluid lines 130 and 140 extend from the second reservoir 410 to the respective dispense control valves 134. The portion of each of the first and third fluid lines 130 and 140 downstream of the second reservoir 410 and upstream of the dispense control valves 134 is minimized to ensure that water moving in the first and third fluid lines 130 and 140 downstream of the dispense control valves 134 is chilled.

In the embodiment illustrated in FIG. 3B, the pump 132 is illustrated as being remote from the first reservoir 402. However, in other embodiments, the pump 132 and its associated fluid connections can also be at least partially housed within the first reservoir 402 to pump water from the first reservoir 402 to the second reservoir 410.

Figure 3C:
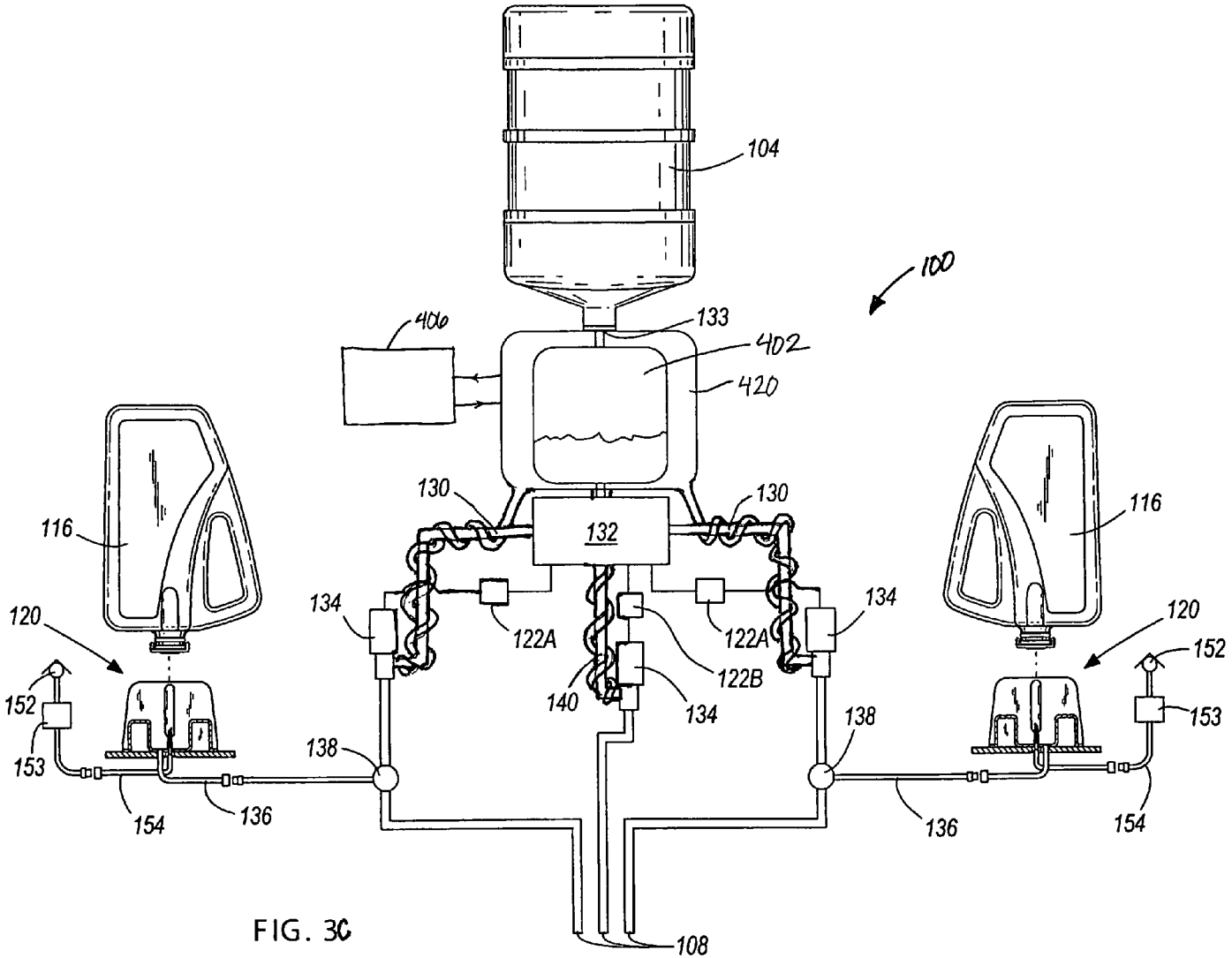
FIG. 3C is schematic view of a beverage dispensing system according to another embodiment of the present invention.

In some embodiments, as shown schematically in FIG. 3C, the beverage dispensing system 100 can include a heat exchanger 420 in fluid communication with the refrigeration system 406, or a portion thereof. For example, the heat exchanger 420 can be defined in whole or in part by an evaporator of the refrigeration system 406. The heat exchanger 420 can be sized and positioned to cool the reservoir 402 and one or more of each of the first fluid lines 130 and the third fluid line 140 upstream of the dispense control valves 134. The heat exchanger 420 can include a refrigerant receiving heat from the reservoir 402 and the first and third fluid lines 130, 140 in order to cool fluid therein. In some embodiments, the refrigerant is a fluid capable of undergoing a phase change by receiving heat from the reservoir 402 and the first and third fluid lines 130, 140.

As shown schematically in FIG. 3C, the heat exchanger 420 can be positioned around or adjacent the reservoir 402 and the first and third fluid lines 130, 140 to receive heat therefrom. The heat exchanger 420 can take a variety of forms commonly used in heat exchangers, including, but not limited to, a jacket (e.g., cladding any part of the reservoir, at least partially surrounding the reservoir 402, and the like), a tube-in-tube configuration, a tube-to-tube configuration (e.g., a coiled path, a serpentine path, and the like), microchannels, and the like, and combinations thereof. Although the heat exchanger 420 in the illustrated embodiment of FIG. 3C is configured to cool the reservoir 402 and portions of the first and third fluid lines 130, 140 upstream of the dispense control valves 134, the heat exchanger 420 can be configured to cool any other portion or combinations of portions of the beverage dispensing system 100 in other embodiments. For example, the heat exchanger 420 can be positioned only to cool the reservoir 402, or only to cool one or more of the first and third fluid lines 130, 140. As another example, the heat exchanger 420 can be positioned to cool one or more portions of the fluid lines 130, 140 downstream of the dispense control valves 134 (e.g., portions of one or more of the fluid lines 130, 140 between the dispense control valves 134 and the mixing valve 138), or any other portions (or substantially all) of the fluid lines 130, 140.

Figure 3D:
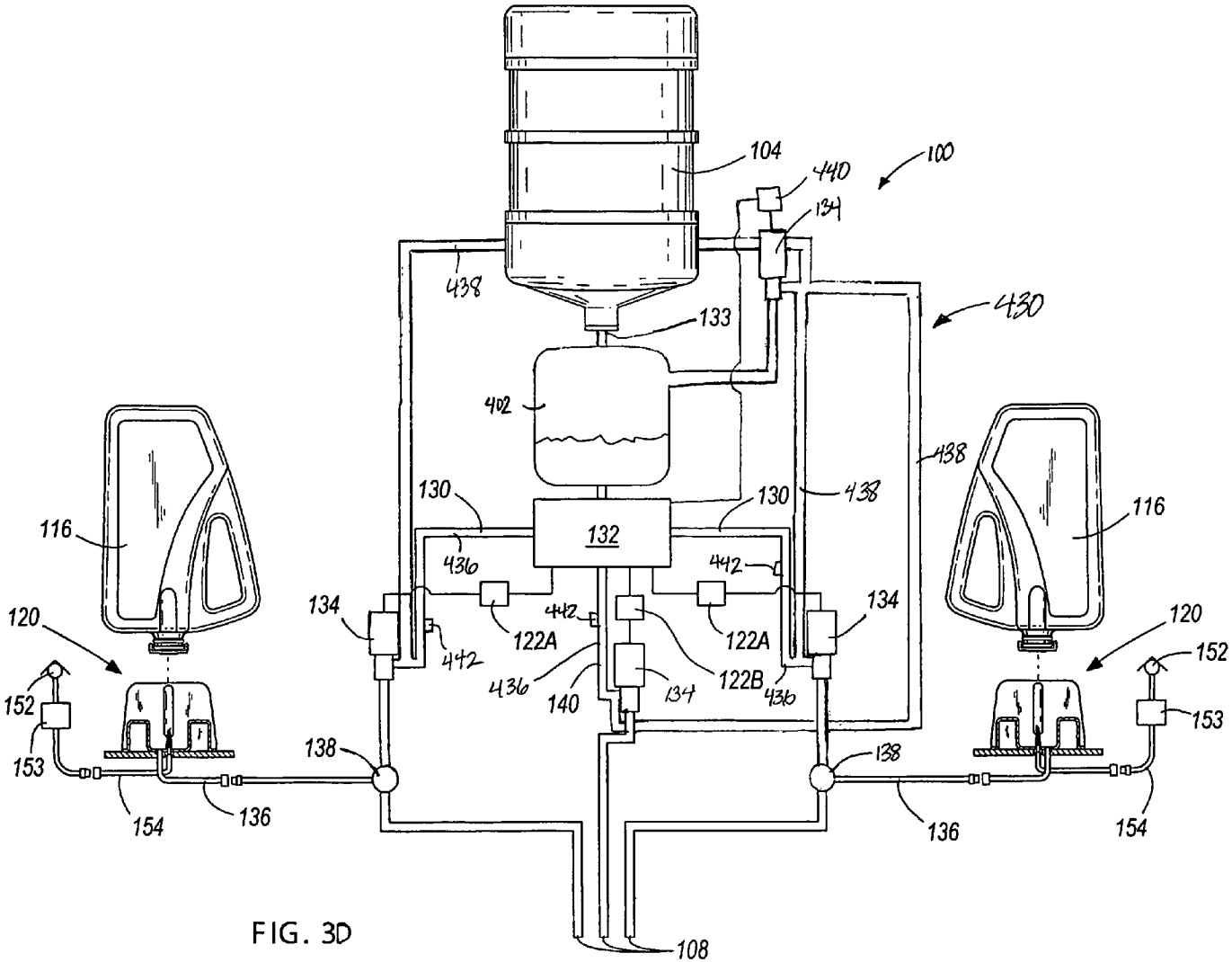
FIG. 3D is schematic view of a beverage dispensing system according to another embodiment of the present invention.

In some embodiments, as shown schematically in FIG. 3D, the beverage dispensing system 100 can include a recirculation system 430 in which the first and/or third fluid lines 130, 140 can be maintained at a desired temperature or within a desired temperature range by redirecting fluid in the first and third fluid lines 130, 140 back to the reservoir 402. The reservoir 402 can be refrigerated or cooled in a variety of manners, including, but not limited to, any of the refrigeration and cooling manners described above.

As shown in FIG. 3D, the first fluid lines 130 and the third fluid line 140 can each include a main portion 436 in fluid communication with a dispensing outlet 108 via the dispense control valve 134 as described above, and a branch portion 438 (e.g., a bleed-off section) in fluid communication with the reservoir 402 via a fourth dispense control valve 134. The location or branch point where each branch portion 438 joins the main portion 436 of each fluid line 130 or 140 can be positioned anywhere along the respective fluid line 130 or 140. In some embodiments, this location is upstream of the dispense control valve 134. Also, in some embodiments, as shown in FIG. 3D, the branch portion 438 can join the main portion 436 immediately upstream of the respective dispense control valve 134 for each fluid line 130, 140.

The branch portions 438 of the recirculation system 430 can converge upstream of the fourth dispense control valve 134 (e.g., immediately upstream thereof, or at any other location), or each branch portion 438 can supply fluid to the fourth dispense control valve 134 individually. The branch portions 438 at least partially define a recirculation loop for each of the fluid lines 130, 140, such that water can be recirculated back to the reservoir 402. The recirculation loop can prevent fluid from remaining in the fluid lines 130 and 140 upstream of the dispense control valves 134 for too long, thereby preventing the fluid from becoming warm while remaining in the fluid lines 130, 140. In some embodiments, the water sitting in the fluid lines 130, 140 is purged to waste rather than being recirculated back to the reservoir 402. For example, in some embodiments, a valve (not shown) can be controlled to direct water from one or more of the fluid lines 130, 140 to a drain or other waste receptacle. In such embodiments, one or more of the branch portions 438 and the fourth dispense control valve 134 can be fluidly coupled to waste (i.e., a drain or waste receptacle), rather than being fluidly coupled to the reservoir 402.

With continued reference to the illustrated embodiment of FIG. 3D, a control 440 can be electrically coupled to the fourth dispense control valve 134 and the pump 132 to turn the pump 132 on and to open the dispense control valve 134 to allow water to flow from the main portion 436 of each of the fluid lines 130, 140 to the reservoir 402. The control 440 can be user-controlled, can include a timer for automatically operating the pump 132 and dispense control valves 134 at particular times or after predetermined periods of time have passed, and/or can be temperature-controlled. For example, in some embodiments, the control 440 can include a user-manipulatable control, similar to those described above, enabling a user to determine when the fluid lines 130, 140 need to be purged. As another example, in some embodiments, the control 440 can include a timer automatically activating the pump 132 and dispense control valves 134 after a predetermined time has passed since a beverage has been dispensed. In some embodiments, one or more temperature sensors 442 can be positioned in fluid communication with one or more of the fluid lines 130, 140, and can send a signal to the control 440 when fluid within one or more of the fluid lines 130, 140 reaches a predetermined temperature. The control 440 can respond to the signal by opening the fourth dispense control valve 134 and by operating the pump 132. Alternatively, the fourth dispense control valve 134 and the pump 132 can be operated directly by one or more temperature sensors 442, in other embodiments.

An embodiment of the dispense control valve 134 and the mixing valve 138 is illustrated in FIG. 4 by way of example. In FIG. 4, the illustrated dispense control valve 134 includes a solenoid valve. The solenoid valve includes a solenoid 142 through which current can be directed to energize the solenoid, create a magnetic field, and direct a rod 144 into or out of the center of the solenoid 142, as will be understood to those of ordinary skill in the art. In the illustrated beverage dispensing system 100 of FIGS. 1-3, the resting position of the rod 144 is a closed position, such that the rod 144 blocks flow through the dispense control valve 134 via the first fluid line 130 when the solenoid is not energized. When the solenoid is energized, however, the magnetic field developed in the solenoid 142 causes the rod 144 to move toward the center of the solenoid 142 and into an open position that allows water to flow in the first fluid line 130 through the dispense control valve 134 and toward the mixing valve 138.

Water is then allowed to flow through the mixing valve 138 to draw in concentrate from the concentrate source 116 into the first fluid line 130, and to be mixed with the water to obtain a beverage of a desired concentration of concentrate. The flow rate of concentrate into the first fluid line 130 (supplied by the mixing valve 138) depends at least in part upon the geometry of the mixing valve 138 (e.g., the open cross-sectional area between the second fluid line 136 and the first fluid line 130) and the volumetric flow rate of water moving through the mixing valve 138.

In some embodiments, as shown in FIG. 4, the mixing valve 138 is adjustable to control the amount of concentrate supplied from the concentrate source 116 to the first fluid line 130. The mixing valve 138 shown in FIG. 4 includes a screw valve 146 having a rod 148 that can be adjusted to decrease the amount of concentrate supplied to the first fluid line 130 or unscrewed to increase the amount of concentrate supplied to the first fluid line 130. The screw valve 146 can be adjustable, for example, by a user-manipulatable concentration control 150 coupled to the housing 102 (see FIGS. 1 and 2) and to the screw valve 146, such as by a rod or other connection between the user-manipulatable concentration control 150 and the rod 148. In this manner, the amount of concentrate supplied to the first fluid line 130 and to the resulting dispensed beverage can be controlled. In embodiments employing a non-adjustable mixing valve 138 and an additional valve in the second fluid line 136 as described above, the user-manipulatable control 150 can be used to manipulate the valve in the second fluid line 136 to control the amount of concentrate allowed to enter the first fluid line 130.

By employing the mixing valve 138, concentrate can be continuously supplied to the first fluid line 130 from the concentrate source 116 at an amount that corresponds to the volumetric flow rate of water moving through the mixing valve 138 to obtain a beverage of a desired concentration of concentrate at any volume. In other words, the beverage dispensing system 100 can dispense any volume of beverage having the desired concentration of concentrate. For example, in some embodiments the mixing valve 138 can supply any desired amount of concentrate in a range of concentrate amounts to the first fluid line 130, wherein the range of concentrate amounts corresponds to a range of water amounts flowing through the first fluid line 130 to produce a corresponding range of dispensed beverage. In addition, the concentration of concentrate in the beverage can be controlled if an adjustable mixing valve 138 is employed, such that any volume of beverage having any desired concentration of concentrate can be dispensed.

In some embodiments, as shown in FIG. 3, the pump 132 is positioned in the first fluid line 130 upstream of the dispense control valve 134 and the mixing valve 138. However, in some embodiments, the pump 132 is positioned downstream of either or both of the dispense control valve 134 and the mixing valve 138. Similarly, in some embodiments, as shown in FIGS. 3 and 4, the dispense control valve 134 is positioned upstream of the mixing valve 138 in the first fluid line 130. However, in other embodiments, the dispense control valve 134 is positioned downstream of the mixing valve 138 in the first fluid line 130.

Figure 5:
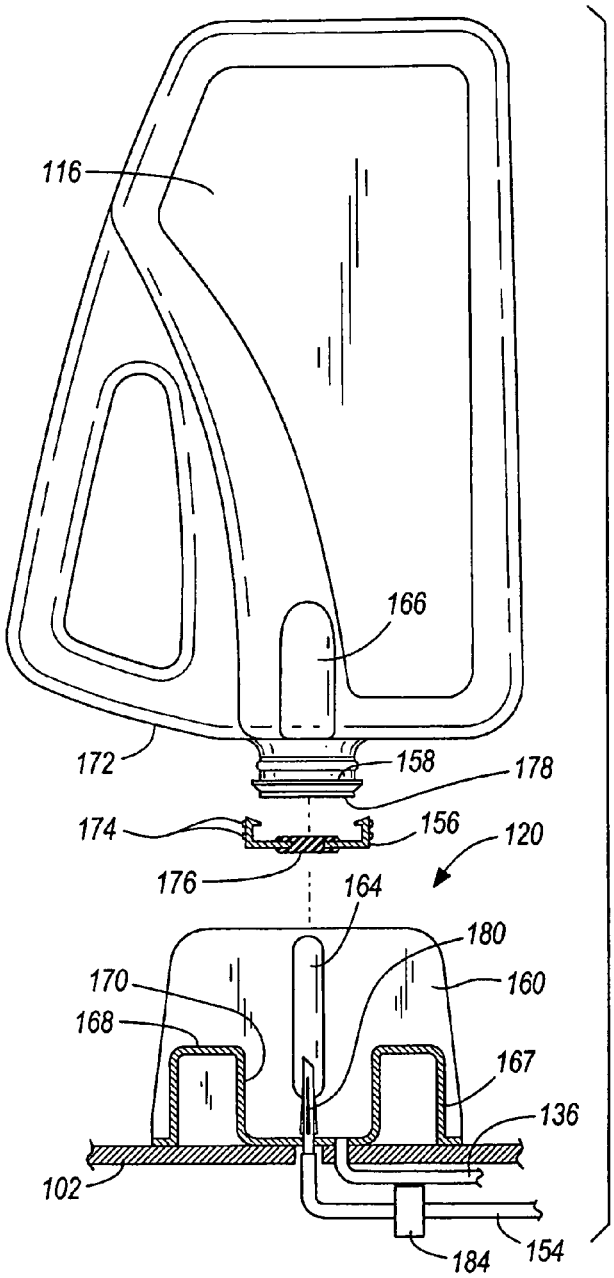
FIG. 5 is an exploded side view of a concentrate source installation assembly according to an embodiment of the present invention, wherein the concentrate source installation assembly has a tube.
Figure 6:
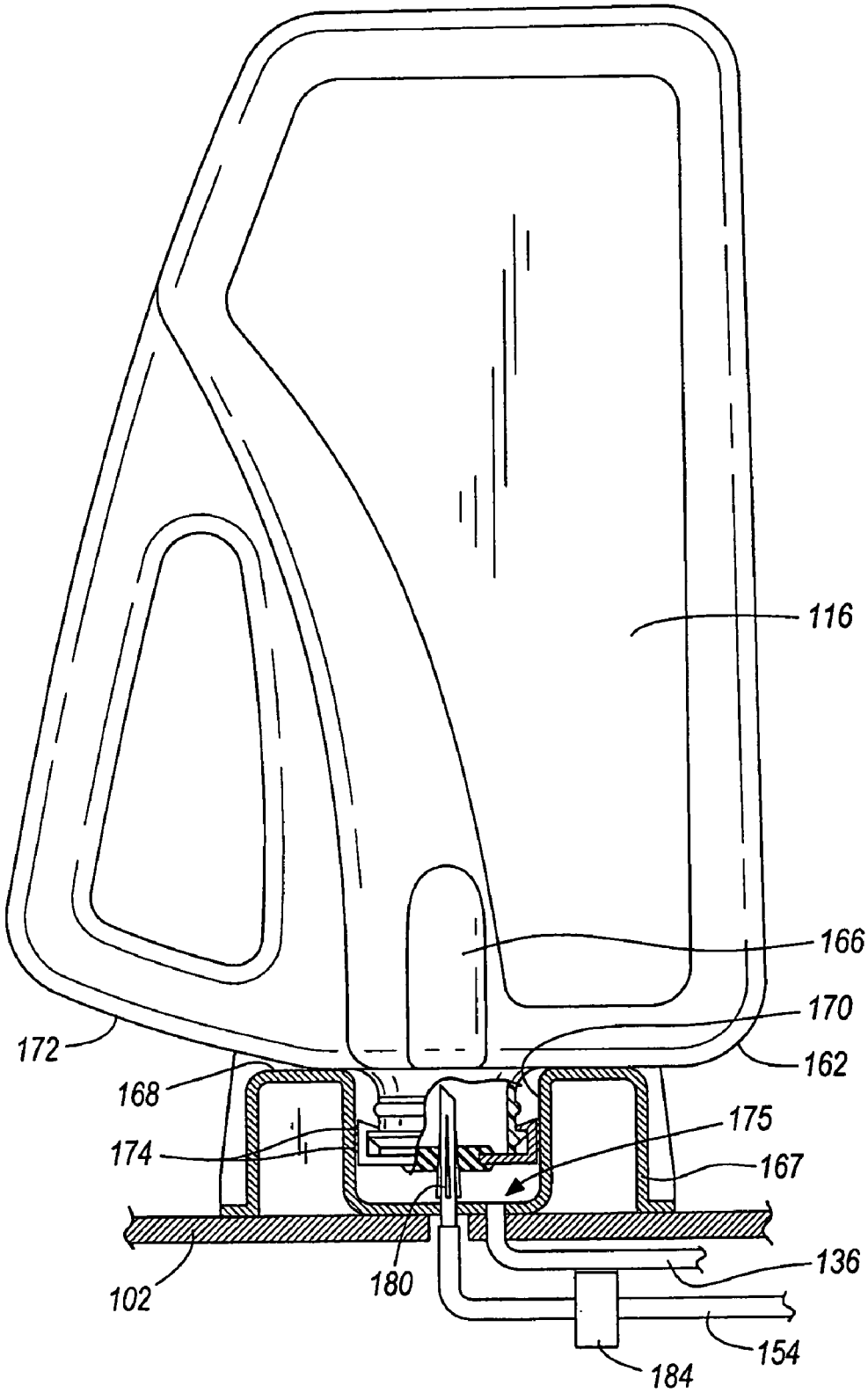
FIG. 6 is an assembled side view of the concentrate source installation assembly of FIG. 5.

FIGS. 5 and 6 illustrate a concentrate source installation assembly 120 according to an embodiment of the present invention. As described above, the concentrate source installation assembly 120 can define a receptacle that receives and, in some embodiments, holds the concentrate source 116. The receptacle can also be used establish fluid communication between the concentrate source 116 and the other components of the beverage dispensing system 100. In some embodiments, as also shown in FIG. 3, the concentrate source installation assembly 120 can provide fluid communication between the concentrate source 116 and the first fluid line 130 (e.g., via the second fluid line 136), and between the concentrate source 116 and an air source or vent 152 (e.g., via an air line 154).

In some embodiments, as shown in FIG. 3, a compressor 153 can be positioned in the air line 154 to pressurize and move air through the air line 154 to the concentrate source 116. The compressor 153 can be used at all times or can be manually or automatically (e.g., by a controller) turned on when needed. As explained in greater detail below, when concentrate is flowing from the concentrate source 116, a reduced pressure or vacuum can develop in the interior of the concentrate source 116. Air from the air line 154 can equalize the pressure within the concentrate source 116 to allow concentrate to continue to exit the concentrate source 116. If utilized, the compressor 153 can provide an "air boost" or "air assist" to more quickly relieve vacuum that develops within the concentrate source 116. For example, when a high-concentrate beverage is being dispensed that requires concentrate to be removed at a rapid rate from the concentrate source 116, the compressor 153 can be turned on to allow concentrate to be removed from the concentrate source 116 at the desired rate. As another example, the compressor 153 can be utilized to generate a positive pressure within the concentrate source 116 in order to help force fluid therefrom.

In some embodiments, as shown in FIG. 3, each concentrate source 116 is fluidly coupled to an air source 152 via an air line 154. In such embodiments, a compressor 153 can be fluidly coupled to each air line 154. However, in some embodiments, two or more concentrate sources 116 are coupled to the same air source 152 via a respective number of air lines 154. In such embodiments, the beverage dispensing system 100 can include one compressor 153 in fluid communication with the single air source 152 and the plurality of air lines 154, or a separate compressor 153 fluidly coupled to each air line 154.

In the illustrated embodiment of FIGS. 5 and 6, and with particular reference to FIG. 6, a cap 156 is dimensioned to receive a portion 158 of the concentrate source 116 (e.g., the neck of a bottle that defines an opening 178 of the concentrate source 116). Alternatively, the cap 156 can be dimensioned to be received within the portion 158 of the concentrate source 116. In some embodiments, the concentrate source 116 is manufactured and sold with the cap 156. In such embodiments, the cap 156 can be integral with the concentrate source 116, or the cap 156 can be assembled with the concentrate source 116 during the manufacture of the concentrate source 116. In other embodiments, the cap 156 is part of the concentrate source installation assembly 120, and can be coupled to the concentrate source 116 prior to positioning the concentrate source 116 into the storage receptacle 114 of the housing 102, and/or prior to fluidly coupling the concentrate source 116 to the first fluid line 130. The cap 156 can be covered by an additional safety cap(s) (not shown) prior to connecting the concentrate source 116 to the beverage dispensing system 100. The safety cap(s) can prevent leaks, and can be removed prior to installing the concentrate source 116 in the concentrate source installation assembly 120.

The housing 102 can include a support 160 positioned within the storage receptacle 114 and adapted to guide the concentrate source 116 into an installed position 162 (as shown in FIG. 6) and to maintain the concentrate source 116 in the installed position 162 during use. The support 160 can include one or more protrusions or recesses 164 adapted to engage one or more recesses or protrusions 166, respectively, on the concentrate source 116 to at least partially maintain the concentrate source 116 in the installed position 162 and in a desired orientation. In some embodiments, the support 160 is flush or integrally formed with an inner wall defining the storage receptacle 114.

The concentrate source installation assembly 120 illustrated in FIGS. 5 and 6 includes a receiver base 167 adapted to receive and hold the concentrate source 116 and to establish fluid communication with the concentrate source 116 and other components of the beverage dispensing system 100 (e.g., the second fluid line 136 and the first fluid line 130). The illustrated receiver base 167 includes an upper surface 168 in which a recess 170 is defined. The upper surface 168 can be dimensioned to engage a shoulder 172 of the concentrate source 116. The recess 170 can be dimensioned to receive the cap 156 and the portion 158 of the concentrate source 116 that engages the cap 156. As shown in FIGS. 5 and 6, the cap 156 can include one or more sealing members 174 (e.g., o-rings, gaskets, or other similar fluid-sealing elements), to engage the portion of receiver base 167 that defines the recess 170, and to create a fluid-tight seal between the concentrate source 116 and the walls of the recess 170. In some embodiments, and as shown in FIG. 6, a chamber 175 is formed in the receiver base 167 between the portion of the receiver base 167 that defines the recess 170 and the cap 156 when the concentrate source 116 is in the installed position 162.

With continued reference to the illustrated embodiment of FIGS. 5 and 6, the cap 156 includes a membrane 176 or similar structure. The membrane 176 can be positioned substantially centrally with respect to the opening 178 of the concentrate source 116. The illustrated concentrate source installation assembly 120 further includes a tube 180 coupled to the receiver base 167 and extending substantially upwardly from the receiver base 167. The tube 180 is shaped to pierce the membrane 176 and to extend into the concentrate source 116 as the concentrate source 116 is moved into the installed position 162. Specifically, the tube 180 establishes fluid communication between the interior of the concentrate source 116 and the chamber 175 when the concentrate source 116 is in the installed position 162. As used herein and in the appended claims, the term "tube" refers to an element or device having a fluid passage therethrough, and does not alone indicate or imply a particular shape (e.g., cross-sectional shape) or size of such an element or device.

Figure 5A:
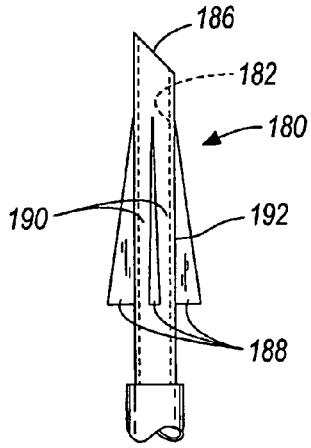
FIG. 5A is a detail view of FIG. 5.

As shown in FIG. 5A, the tube 180 is hollow and defines a lumen 182. The lumen 182 of the tube 180 is in fluid communication with the air source or vent 152 (see FIG. 3) via the air line 154. Thus, the lumen 182 forms at least a portion of the air line 154. As a result, when the concentrate source 116 is in the installed position 162, as shown in FIG. 6, air is allowed to enter the interior of the concentrate source 116 via the lumen 182 of the tube 180 to equalize the pressure within the concentrate source 116 when concentrate is being drawn toward the first fluid line 130. A check valve 184 can be positioned in fluid communication with the air line 154 to prevent concentrate from entering the air line 154. A variety of types of check valves 184 or any other type of suitable valve can be used for this purpose without departing from the spirit and scope of the present invention.

In some embodiments, as shown in FIGS. 5, 5A and 6, the tube 180 includes a sharp end 186 (which, in some embodiments, is beveled) for piercing the membrane 176. In addition, the tube 180 includes one or more protrusions 188 that extend radially outwardly from the body of the tube 180 and along at least a portion of the length of the tube 180. Specifically, the protrusions 188 extend along the portion of the length of the tube 180 that passes through the membrane 176. The protrusions 188 define a series of recesses 190 therebetween. When the tube 180 is passed through the membrane 176, the recesses 190 define a series of fluid lines between the membrane 176 and the recesses 190 through which concentrate can flow. These fluid lines aggregately define a concentrate fluid line 192 from the interior of the concentrate source 116 to the chamber 175 in the receiver base 167. As a result, by virtue of the shape and configuration of the illustrated tube 180, the tube 180 defines two fluid lines: (1) the concentrate fluid line 192 extending along the outside of the tube 180, defined by the recesses 190, and through which concentrate can exit the concentrate source 116, and (2) the air line 154 extending through the lumen 182 of the tube 180 through which air can enter the interior of the concentrate source 116. Concentrate is allowed to pool in the chamber 175, which is fluidly coupled to the second fluid line 136.

In some embodiments, the cap 156, the tube 180, and the receiver base 167 can be disconnected and removed from the storage receptacle 114 of the housing 102 to be replaced or cleansed and reused. This disconnection and removal feature can be enabled by releasable connecting elements on the receiver base 167 and/or on the housing 102, such as tabs, clips, or other elements retaining the receiver base 167 in place, by screws, pins, bolts, or other releasable fasteners, by a receptacle defined in a portion of the housing 102 and in which at least a portion of the receiver base 167 is received, and the like.

The receiver base 167 illustrated in FIGS. 5 and 6 is coupled to a bottom wall of the housing 102. However, it should be understood that the receiver base 167 can instead be coupled to any other wall of the housing 102, depending at least in part upon the location and orientation of the storage receptacles 114 therein when coupled to the receiver base 167. Also, the receiver base 167 can be coupled to any intermediate structure or device that is coupled to and/or received within the storage receptacle 114 of the housing 102, such as to a drawer, a shelf, a wall, a tray, a floor, a plate, a frame, and the like, or combinations thereof. In such embodiments, the intermediate structure can be removed with the receiver base 167 from the storage receptacle 114, thereby enabling easier cleaning of the storage receptacle 114, the intermediate structure, and/or the receiver base 167, if desired.

As shown in FIGS. 5 and 6, the tube 180 need not extend significantly into the interior of the concentrate source 116 to establish and maintain fluid communication between the interior of the concentrate source 116 and the chamber 175. For example, and as shown in FIG. 6, in some embodiments the tube 180 does not extend into the interior of the concentrate source 116 past a spout of the concentrate source 116 and/or past a shoulder 172 of the concentrate source 116. In these and other embodiments, the tube 180 can remain below the level of concentrate within the concentrate source 116 for all or substantially all quantities (e.g., at least 90%) of concentrate within the concentrate source 116. The degree of penetration of the tube 180 into the concentrate source 116 can depend at least in part upon the shape and configuration of the concentrate source 116.

In some embodiments (see FIG. 6) the tube 180 does not extend substantially higher than the upper surface 168 of the receiver base 167. Furthermore, the lumen 182 of the tube 180 need not be in direct fluid communication with any air within the concentrate source 116. That is, air entering the interior of the concentrate source 116 via the lumen 182 of the tube 180 can adequately equalize pressure within the concentrate source 116 without requiring that the tube 180 extend to a region within the concentrate source 116 that may be filled with air.

In some embodiments, the tube 180 does not include a sharp end 186, but rather includes a dull end that can be forced through a portion of the membrane 176. Also, a portion of the membrane 176 can include a slit, an area of reduced thickness, or another suitable configuration preventing concentrate from spilling out of the concentrate source 116 when the concentrate source 116 is inverted, but that does not need to be pierced or punctured to establish fluid communication with the tube 180.

In some embodiments, the receiver base 167 includes a snap-fit engagement with the cap 156 or the portion 158 of the concentrate source 116 such that a user feels and/or hears a "click" when installing the concentrate source 116 (e.g., to the installed position 162), thereby assuring the user that fluid communication has been properly established. For example, one or more walls of the recess 170 can have one or more notches, grooves, or other recesses dimensioned to receive the sealing members 174 in a snap-fit engagement. In some embodiments, the engagement between the protrusions/recesses 164 of the support 160 and the recesses/protrusions 166 of the concentrate source 116 can include a snap-fit engagement to allow a user to feel and/or hear a "click" when the concentrate source 116 has been properly installed to the installed position 162.

Figure 6A:
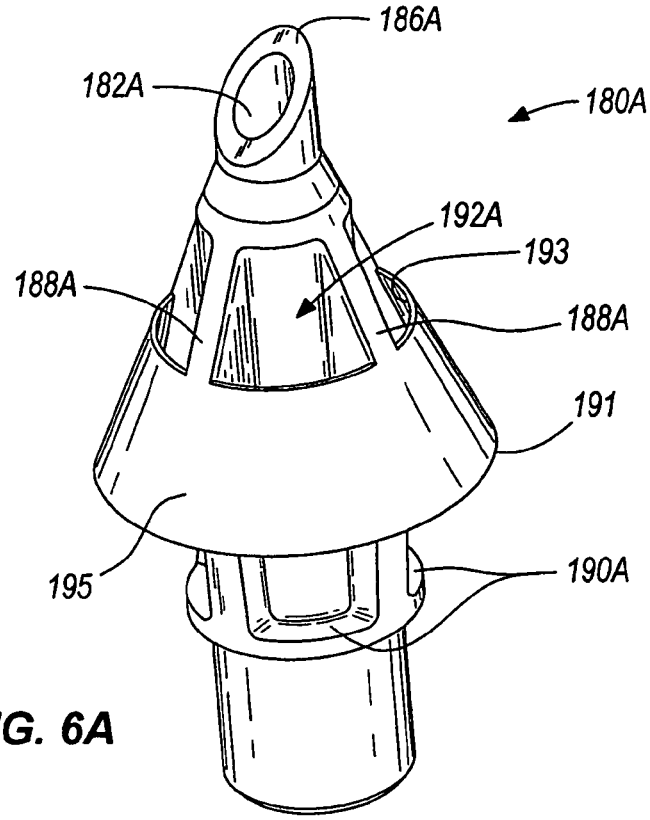
FIG. 6A is a front perspective view of a tube according to another embodiment of the present invention.
Figure 6B:
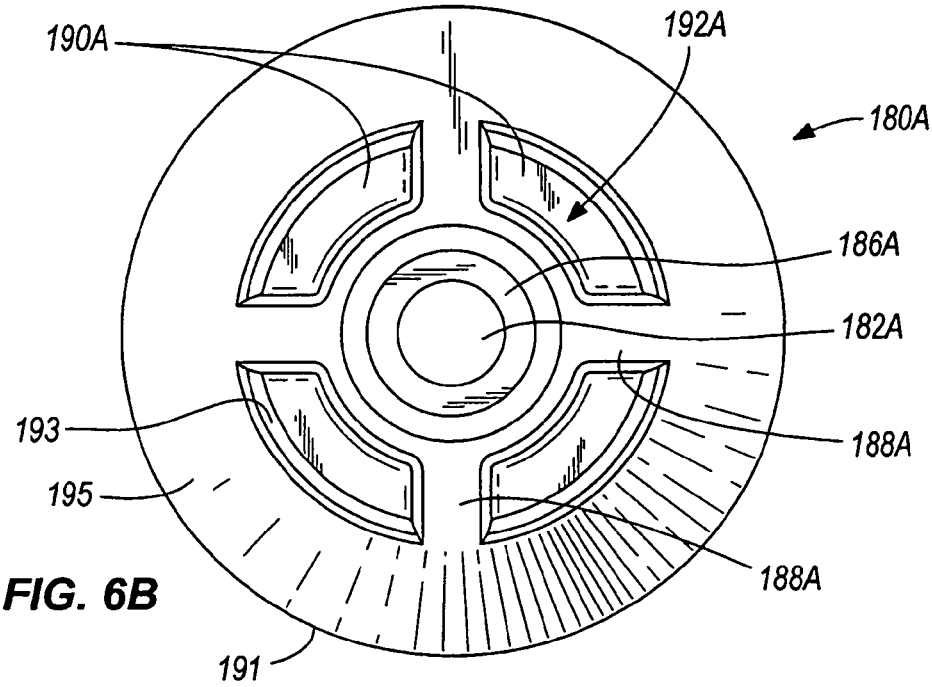
FIG. 6B is a top view of the tube of FIG. 6A.

FIGS. 6A and 6B illustrate a tube 180A according to another embodiment of the present invention. The tube 180A shares many of the same or similar elements and features described above with reference to the embodiment illustrated in FIGS. 5-6. Accordingly, elements and features corresponding to elements and features in the illustrated embodiment of FIGS. 5-6 are provided with the same reference numerals followed by the letter "A." Reference is made to the description above accompanying FIGS. 5-6 for a more complete description of the features and elements (and alternatives to such features and elements) of the embodiment illustrated in FIGS. 6A and 6B.

The tube 180A illustrated in FIGS. 6A and 6B includes a sharp end 186A, protrusions 188A, and a number of recesses 190A defined therebetween. The recesses 190A define a series of fluid lines that aggregately define a concentrate fluid line 192A. In addition, the tube 180A illustrated in FIGS. 6A and 6B includes a frusto-conical portion 191 positioned approximately centrally with respect to the length of the tube 180A. The frusto-conical portion 191 can be located at a variety of positions along the length of the tube 180A, depending at least in part upon the configuration of the concentrate source installation assembly 120, the shape and size of the concentrate source 116, and upon the configuration of any of the other structures in the environment of the tube 180A.

The frusto-conical portion 191 includes an inner surface 193 and an outer surface 195. The inner surface 193 is coupled to at least a portion of an outer surface of each of the protrusions 188A. Thus, the concentrate fluid line 192A is defined by the recesses 190A and at least partially by the inner surface 193 of the frusto-conical portion 191.

The tube 180A can be sized and dimensioned such that when the concentrate source 116 is in the installed position 162, and the tube 180A is positioned through the membrane 176 of the cap 156, the membrane 176 rests on the outer surface 195 of the frusto-conical portion 191. As a result, the frusto-conical portion 191 inhibits the membrane 176 from obstructing the concentrate fluid line 192A. Thus, the frusto-conical portion 191 allows concentrate to flow from the interior of the concentrate source 116 to the chamber 175 of the concentrate source assembly 120 via the concentrate fluid line 192A substantially without obstruction.

Both tubes 180, 180A described above can be formed of one element (i.e., part, piece or component) or can be formed of two or more elements coupled together in any suitable manner. In some embodiments, the tube 180, 180A can be formed of one element that is covered or coated by material defining another element. For example, a first substantially cylindrical element that defines the lumen 182, 182A can be overmolded with a second element that defines the other structures (i.e., protrusions 188, 188A, recesses 190, 190A, and the frusto-conical portion 191, and the like). The first and second elements can be formed of the same or different material. For example, the first portion can be formed of a metal, and the second portion can be formed of a polymer. In addition, the tube 180, 180A can be formed of two elements (i.e., parts, pieces or components) that are formed separately and then attached together. For example, a first substantially cylindrical element that defines the lumen 182, 182A can be positioned within a second element that defines the other structures. The first and second elements can be formed of the same or a different material.

The tubes 180, 180A illustrated in FIGS. 5-6B each have a plurality of protrusions 188, 188A and recesses 190, 190A for the purpose of facilitating fluid flow as described above. The protrusions 188, 188A and recesses 190, 190A can have a number of different sizes and shapes while still performing this function. Also, any number of protrusions 188, 188A and recesses 190, 190A can be utilized in other embodiments to collectively define the concentrate fluid line 192, 192A as also described above. Furthermore, the tubes 180, 180A can have other overall shapes while still functioning to spread a membrane 176 or other pierced portion of the concentrate source 116. For example, the tubes 180, 180A can be blunted, can have a concave or convex shape along any part or all of the protrusions 188, 188A, and the like.

Figure 6C:
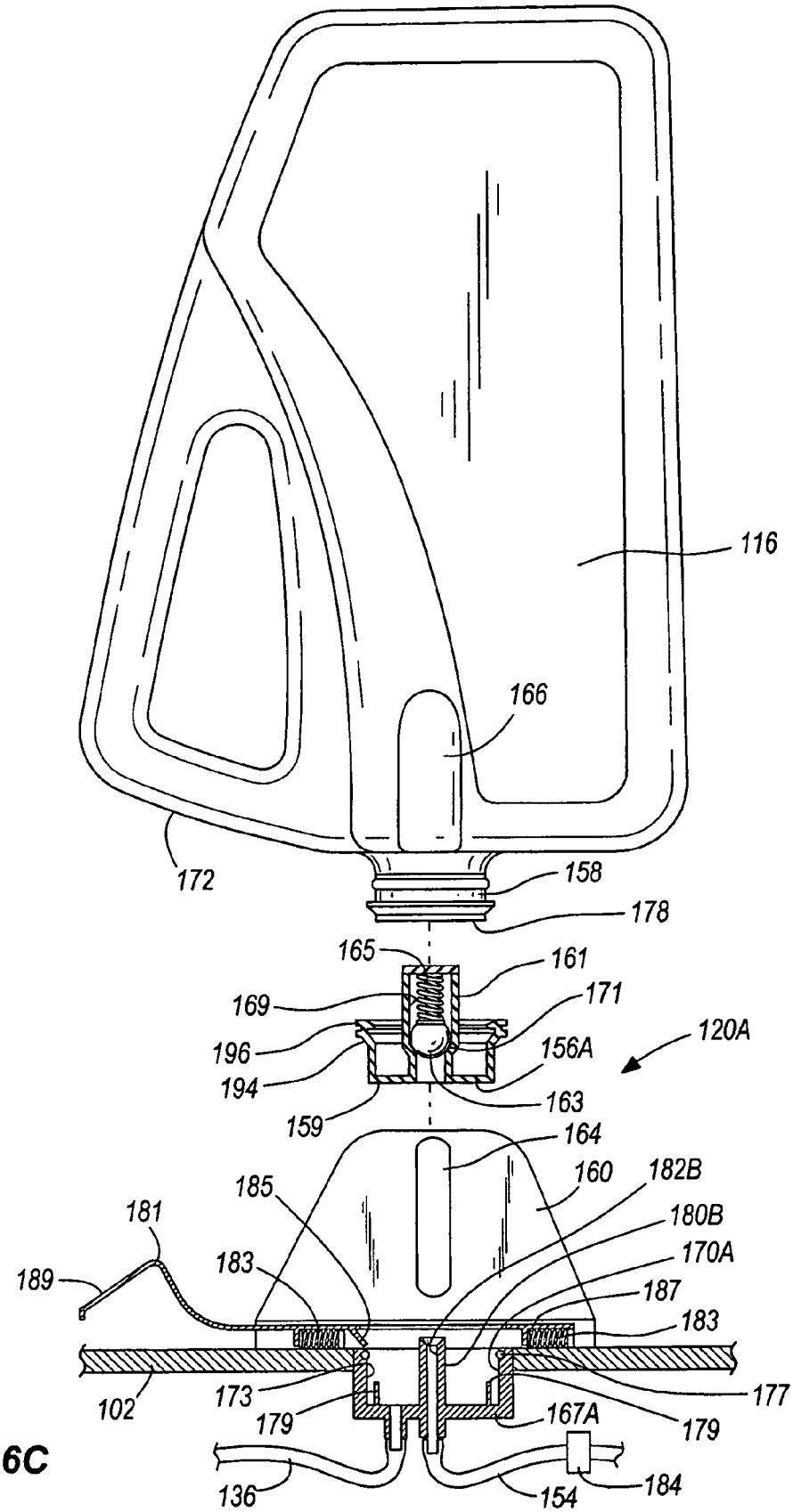
FIG. 6C is an exploded side view of a concentrate source installation assembly according to another embodiment of the present invention.
Figure 6D:
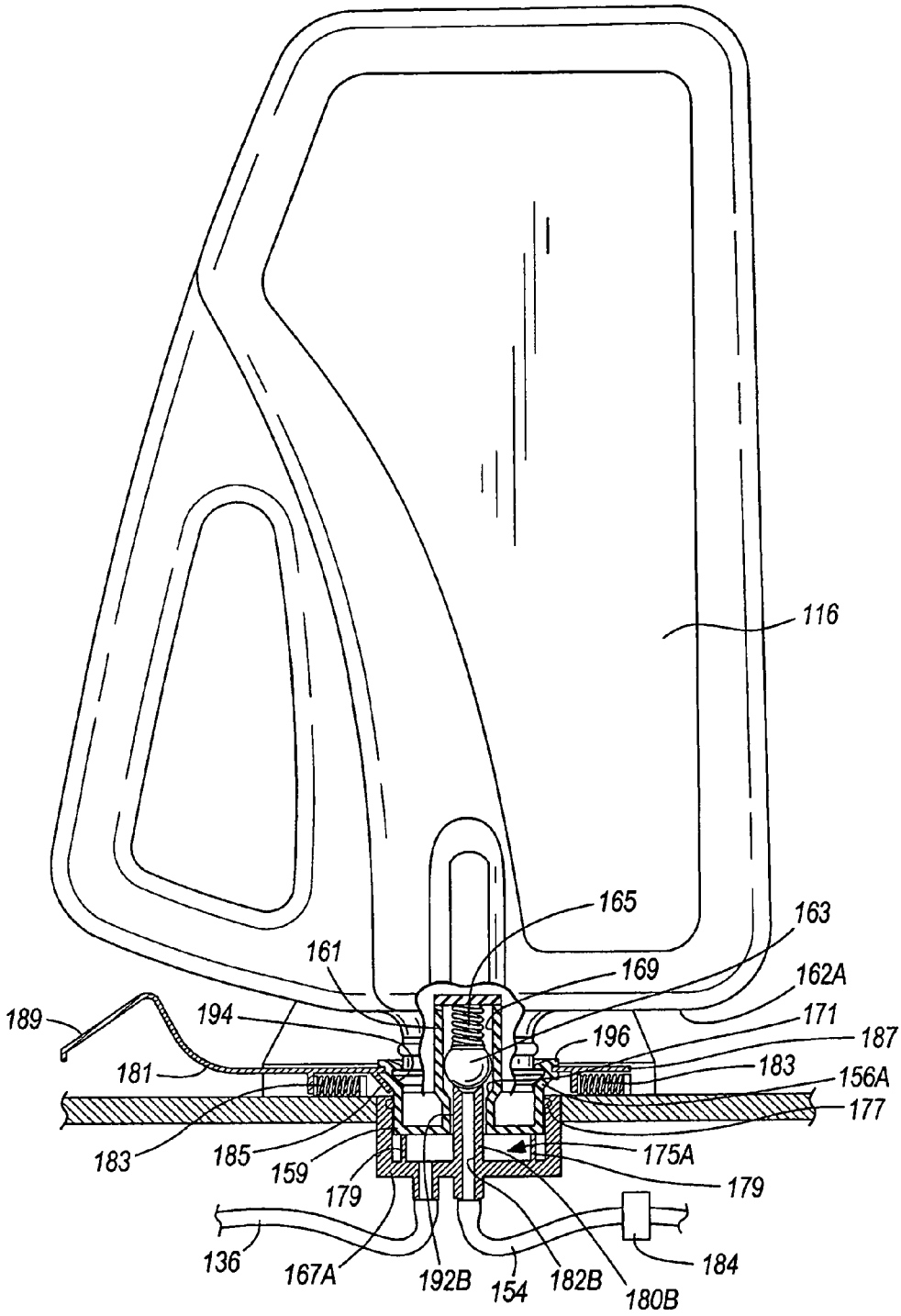
FIG. 6D is an assembled side view of the concentrate source installation assembly of FIG. 6C.
Figure 6E:
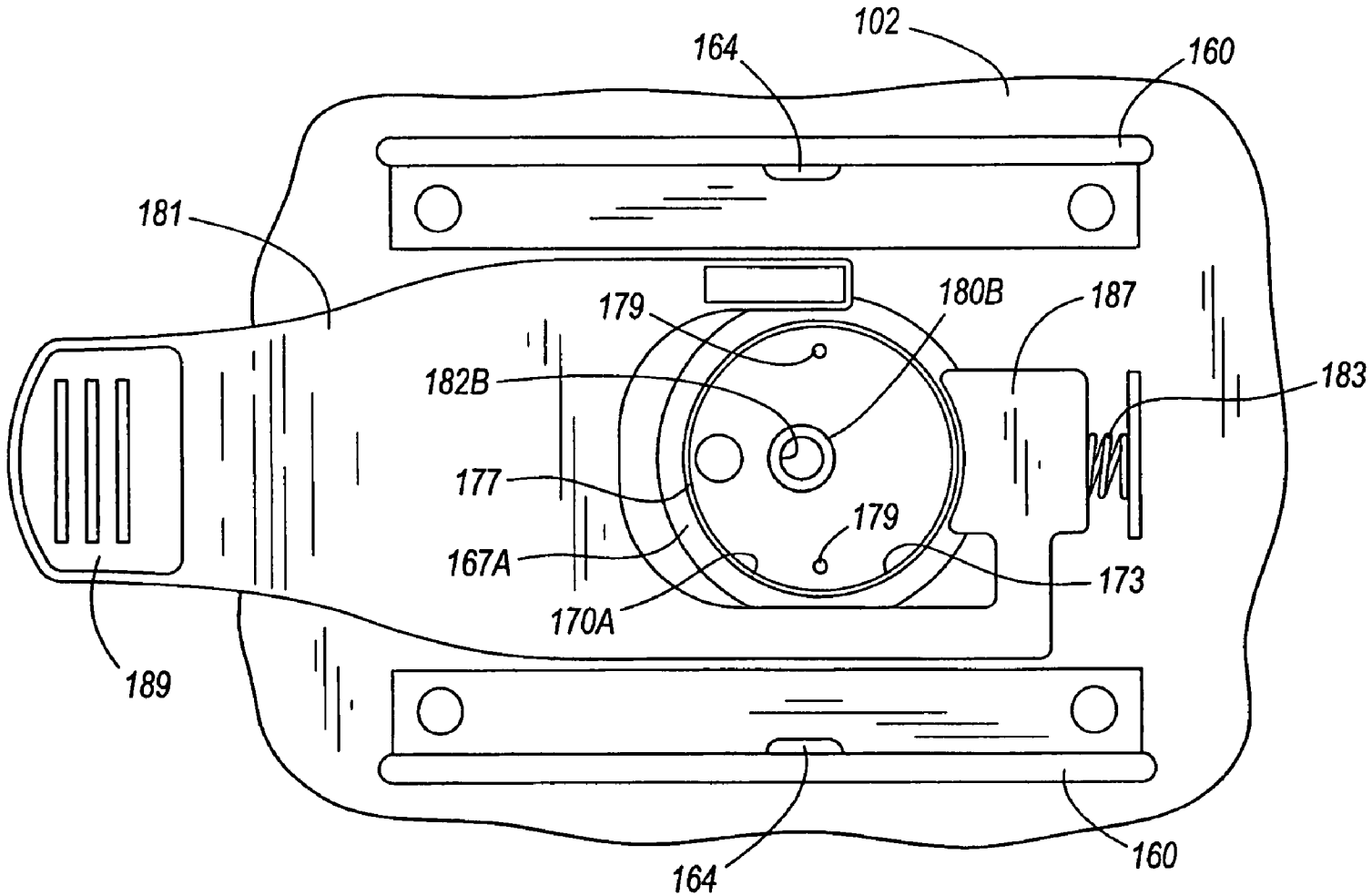
FIG. 6E is a top partial view of the concentration source installation assembly of FIGS. 6C and 6D.

FIGS. 6C-6E illustrate a concentrate source installation assembly 120A according to another embodiment of the present invention. The concentrate source installation assembly 120A shares many of the same or similar elements and features described above with reference to the embodiment illustrated in FIGS. 5-6. Accordingly, elements and features corresponding to elements and features in the illustrated embodiment of FIGS. 5-6 are provided with the same reference numerals followed by the letter "A" or "B." Reference is made to the description above accompanying FIGS. 5-6 for a more complete description of the features and elements (and alternatives to such features and elements) of the embodiment illustrated in FIGS. 6C-6E.

The concentrate source installation assembly 120A illustrated in FIGS. 6C-6E includes a cap 156A dimensioned to receive a portion 158 of the concentrate source 116. In the embodiment illustrated in FIGS. 6C-6D, the cap 156A includes a circumferential notch that engages a circumferential protrusion of the portion 158 in a snap-fit type engagement. Other types of permanent and releasable connections are possible in alternative embodiments. The cap 156A includes a first portion 159 that extends out of the opening 178 of the concentrate source 116, and a second portion 161 that extends inwardly through the opening 178 of the concentrate source 116 and into the interior of the concentrate source 116. The second portion 161 of the illustrated cap 156A includes a substantially tubular shape, and the interior of the second portion 161 is in fluid communication with the interior of the concentrate source 116 when the cap 156A is installed on the concentrate source 116.

The cap 156A further includes a ball 163 biased by a biasing element 165 (e.g., a spring). The ball 163 and biasing element 165 are coupled to the second portion 161 of the cap 156A such that fluid communication is maintained between the interior of the second portion 161 and the interior of the concentrate source 116. The second portion 161 of the cap 156A includes an inner surface 169 that is shaped and dimensioned to provide a fluid-tight seat 171 for the ball 163, wherein the ball 163 is biased toward the seat 171 by the biasing element 165. As a result, prior to installing the concentrate source 116 in the concentrate source installation assembly 120A, concentrate is prevented from spilling out of the concentrate source 116 by the ball 163 in fluid-tight engagement with the inner surface 169 of the second portion 161 of the cap 156A (i.e., biased against the seat 171 of the cap 156A).

The concentrate source installation assembly 120A further includes a receiver base 167A coupled to the housing 102 within the storage receptacle 114. Specifically, the receiver base 167A illustrated in FIGS. 6C-6E extends downwardly through a portion of the housing 102 that defines a floor, shelf, ledge, or other support structure of the storage receptacle 114. In some embodiments, the receiver base 167A can be located in or coupled to a removable tray, plate, frame or other structure, which can assist in cleaning various portions of the concentration source installation assembly 120A and/or the housing 102. Such structures can also be included in, or used in combination with, any of the other embodiments disclosed herein.

The receiver base 167A includes an inner surface 173 that defines a recess 170A dimensioned to receive the cap 156A and the portion 158 of the concentrate source 116 when the concentrate source 116 is in an installed position 162A (see FIG. 6D). The inner surface 173 can include, or can be coupled to, one or more sealing members 177 (e.g., o-rings, gaskets, or other similar fluid-sealing elements) positioned to seal against the first portion 159 of the cap 156A when the cap 156A is positioned within the recess 170A, such that a chamber 175A is formed in the receiver base 167A between the inner surface 173 and the cap 156A when the concentrate source 116 is in the installed position 162A. As shown in FIGS. 6C and 6D, the chamber 175A is in fluid communication with the interior of the concentrate source 116 via the interior of the second portion 161 of the cap 156A, and in fluid communication with the other components of the beverage dispensing system 100 via the first fluid line 130 and the second fluid line 136.

To further define the installed position 162A of the concentrate source 116, the receiver base 167A further includes one or more upwardly-extending protrusions 179 that extend upwardly from the inner surface 173 at the bottom of the receiver base 167A. The upwardly-extending protrusions 179 provide a stop for the first portion 159 of the cap 156A when the concentrate source 116 is moved into the installed position 162A. The upwardly-extending protrusions 179 can have a variety of different shapes and configurations, including a series of upwardly-protruding posts, a broken or unbroken annular, upwardly-extending wall, and the like. In other embodiments, the concentrate source 116 is stopped by abutment of one or more other portions of the concentrate source 116 against one or more portions of the receiver base 167A. Also, the protrusions(s) 179 can be utilized in the other embodiments of the present invention described and illustrated herein.

The receiver base 167A further includes a tube 180B coupled to the receiver base 167A and extending substantially upwardly from the receiver base 167A. The tube 180B can take any of the forms described herein, and in the illustrated embodiment of FIGS. 6C-6E is shaped to cup the ball 163. Unlike the tubes 180, 180A described above, the tube 180B illustrated in FIGS. 6C and 6D does not need to extend into the concentrate source 116, because the second portion 161 of the cap 156A extends into the concentrate source 116 to establish fluid communication between the interior of the concentrate source 116 and the receiver base 167A. As the concentrate source 116 is moved into the installed position 162A, the tube 180B engages and unseats the ball 163 from the seat 171 against the bias of the biasing element 165.

When the ball 163 has been unseated by the tube 180B, the tube 180B establishes fluid communication between the interior of the concentrate source 116 and the chamber 175A. Specifically, as shown in FIG. 6D, when the ball 163 is moved away from the seat 171, concentrate is allowed to flow from the interior of the concentrate source 116, through the interior of the second portion 161 of the cap 156A, around the ball 163 and tube 180B, into the chamber 175A, and into the second fluid line 136 (or the first fluid line 130, if the second fluid line 136 is not employed).

As shown in FIGS. 6C and 6D, the tube 180B is hollow and defines a lumen 182B. The lumen 182B of the tube 180B is in fluid communication with the air source or vent 152 (see FIG. 3) via the air line 154. Thus, the lumen 182B forms at least a portion of the air line 154. As a result, when the concentrate source 116 is in the installed position 162A as shown in FIG. 6, air is allowed to enter the lumen 182B of the tube 180B. When negative pressure develops within the interior of the concentrate source 116 due to concentrate being drawn out of the concentrate source 116, the ball 163 is temporarily moved against the bias of the biasing element 165 to allow air to flow from the lumen 182B into the interior of the second portion 161 of the cap 156A, and into the interior of the concentrate source 116.

As a result, the tube 180B illustrated in FIGS. 6C and 6D defines two fluid lines: (1) a concentrate fluid line 192B extending along the outside of the tube 180B through which concentrate can exit the concentrate source 116, and (2) the air line 154 extending through the lumen 182B of the tube 180B through which air can enter the interior of the concentrate source 116. Concentrate is allowed to pool in the chamber 175A, which is fluidly coupled to the second fluid line 136.

As shown in FIGS. 6C-6E, the illustrated concentrate source installation assembly 120A further includes a mounting clip 181 that includes an arm 187 shaped and dimensioned to engage the cap 156A and/or the concentrate source 116 to maintain the concentrate source in the installed position 162A. Specifically, the cap 156A includes one or more outwardly-extending protrusions 196 shaped to engage the arm 187. In other embodiments, the cap 156A or concentrate source can have one or more protrusions and/or apertures releasably engagable with the arm 187 in order to retain the concentrate source 116 in engagement with the receiver base 167A. In some embodiments, the mounting clip 181 can also or instead have a portion shaped and dimensioned to assist in disengagement of the concentrate source 116 from the receiver base 167A by engaging the cap 156A or portion of the concentrate source 116. In the illustrated embodiment of FIGS. 6C-6E for example, the mounting clip 181 has a ramp 185 positioned to engage a portion 194 of the cap 156A when the mounting clip 181 is actuated by a user. The portion 194 of the cap 156 can be inclined for this purpose. Also, an inclined portion of the cap 156 can engage a non-inclined portion of the mounting clip 181 to disengage the concentrate source 116 in other embodiments. The mounting clip 181 illustrated in FIGS. 6C-6E further includes biasing elements 183 (e.g., springs) for biasing the mounting clip 181 in a desired direction with respect to the concentrate source 116 (e.g., into engagement with the cap 156), and a lever 189 for user actuation of the mounting clip 181.

When the concentrate source 116 illustrated in FIGS. 6C and 6D is moved into the installed position 162A, the inclined portion 194 and/or outwardly-extending protrusion 196 cause the mounting clip 181 to temporarily move left to right against the bias of the biasing elements 183, and the cap 156A is snapped into engagement with the arm 187. When it is desired to remove the concentrate source 116 from the installed position 162A, the lever 189 can be pushed from left to right against the bias of the biasing elements 183. Pushing the lever 189 against the bias of the biasing elements 183 causes the engaging portion 187 to be disengaged from the outwardly-extending protrusions 196, and the ramp 185 to push against the inclined portion 194 of the cap 156A. This motion forces the cap 156A out from sealing engagement with the sealing members 177 of the receiver base 167A, thereby allowing the concentrate source 116 to be removed. It should be understood by those of ordinary skill in the art that the mounting clip 181 can instead be configured such that pulling the lever 189 (i.e., instead of pushing the lever 189 against the bias of the biasing elements 183) releases the cap 156A from the receiver base 167A.

FIG. 7 illustrates another beverage dispensing system 200 according to the present invention, wherein like numerals represent like elements. The beverage dispensing system 200 shares many of the same elements and features described above with reference to the illustrated embodiment of FIGS. 1-6. Accordingly, elements and features corresponding to elements and features in the illustrated embodiment of FIGS. 1-6 are provided with the same reference numerals in the 200 series. Reference is made to the description above accompanying FIGS. 1-6 for a more complete description of the features and elements (and alternatives to such features and elements) of the embodiment illustrated in FIG. 7.

The beverage dispensing system 100 illustrated in FIG. 7 includes a housing 202, a water source 204, a dispensing outlet 208, and a recess 210 defined by the housing 202 in which a receptacle (e.g., a pitcher, glass, bottle, and the like) can be positioned to collect a beverage dispensed from the dispensing outlet 208. The housing 202 further defines a storage receptacle 214 for housing one or more concentrate sources 216. The storage receptacle 214 is accessible by a drawer 217. The dispensing outlet 208 is in fluid communication with the water source 204 and one or more concentrate sources 216 via respective ports that dispense the desired beverage into and through the dispensing outlet 208.

The drawer 217 includes an aesthetically pleasing front 219 and a floor 221. As shown in FIG. 7, the drawer 217 allows the concentrate sources 216 to be positioned in the drawer 217 and slid into the storage receptacle 214 to facilitate removal and replacement of the concentrate sources 216 from the storage receptacle 214. One or more concentrate source installation assemblies 220 can be coupled to the floor 221 of the drawer to allow the concentrate sources 216 to be fluidly coupled to other components of the beverage dispensing system 200 upon positioning the concentrate source 216 in the drawer 217. As shown in FIG. 7, a fluid line 236 and an air line 254 are long enough to allow the drawer 217 to be moved between open and closed positions while maintaining fluid communication between the concentrate source 216 and other components of the beverage dispensing system 200.

FIGS. 8 and 9 illustrate another beverage dispensing system 300 according to the present invention, wherein like numerals represent like elements. The beverage dispensing system 300 shares many of the same elements and features described above with reference to the illustrated embodiment of FIGS. 1-6. Accordingly, elements and features corresponding to elements and features in the illustrated embodiment of FIGS. 1-6 are provided with the same reference numerals in the 300 series. Reference is made to the description above accompanying FIGS. 1-6 for a more complete description of the features and elements (and alternatives to such features and elements) of the embodiment illustrated in FIGS. 8 and 9.

The beverage dispensing system 300 shown in FIGS. 8 and 9 includes a housing 302, a display 306, a dispensing outlet 308, and a recess 310 defined by the housing 302 in which a receptacle (e.g., a pitcher, glass, bottle, and the like) can be positioned to collect a beverage dispensed from the dispensing outlet 308. The housing 302 further defines a storage receptacle 314, accessible by a door 315, for housing one or more concentrate sources 316. In some embodiments, as shown in FIGS. 8 and 9, the display 306, the dispensing outlet 308 and the recess 310 are all at least partially defined by the door 315 and move with the door 315 when the door 315 swings between opened and closed positions. This arrangement of elements can be utilized in any of the beverage dispensing system embodiments described and illustrated herein. In other embodiments, the display 306, the dispensing outlet 308 and/or the recess 310 can be located on other portion(s) of the housing 302, and as a result, can be stationary with respect to the door 315.

The beverage dispensing system 300 illustrated in FIGS. 8 and 9 is generally shorter and smaller than the beverage dispensing systems 100 and 200 illustrated in FIGS. 1-7 and described above. As a result, the beverage dispensing system 300 can be positioned atop a countertop, lab bench, desk, table, and the like. In addition, the beverage dispensing system 300 is portable. The beverage dispensing system 300 can be coupled to a water source 304; however, the water source 304 can be different from the water sources 104 and 204 illustrated in FIGS. 1-7. Specifically, the water source 304 can include a faucet or other similar tap into a city water supply, or any other suitable external water supply that can be coupled to the housing 102 via standard fluid fittings and connections known to those of ordinary skill in the art.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the receiver base 167 illustrated in the embodiments of FIGS. 2, 3, 5, 6, and 7-9 is different from the receiver base 167A illustrated in the embodiment of FIGS. 6C-6E. It should be noted that either of the receiver bases 167, 167A can be utilized in any of the embodiments described herein and illustrated in the accompanying figures.

Various features and aspects of the invention are set forth in the following claims.

What is claimed is:

1. A beverage dispensing system for dispensing a beverage comprising water from a water source, the beverage dispensing system comprising:

a housing;

a single inlet adapted to be coupled to the water source;

a concentrate source removably positioned within a storage receptacle of the housing and adapted to contain concentrate;

a first dispensing outlet from which a first fluid comprising at least one of water and concentrate is dispensed from the beverage dispensing system;

a second dispensing outlet from which a second fluid comprising at least one of water and concentrate is dispensed from the beverage dispensing system, wherein the first fluid is different from the second fluid;

a first fluid line fluidly coupling the water source and the first dispensing outlet;

a second fluid line fluidly coupling the water source and the second dispensing outlet;

a pump fluidly coupled between the inlet and the first fluid line and between the inlet and the second fluid line, the pump being operable to move water at a volumetric flow rate from the water source to the first dispensing outlet via the first fluid line, the pump being operable to move water at a volumetric flow rate from the water source to the second dispensing outlet via the second fluid line;

a mixing valve positioned in the first fluid line fluidly connecting the concentrate source and the first fluid line to supply an amount of concentrate from the concentrate source to the first fluid line, the amount of concentrate corresponding to the volumetric flow rate of the water in the first fluid line and a desired concentration of concentrate in the beverage to be dispensed, the concentrate being moved into the first fluid line by operation of the pump.

2. The beverage dispensing system of claim 1, wherein at least a portion of the storage receptacle is refrigerated.

3. The beverage dispensing system of claim 1, wherein the mixing valve comprises a Venturi valve.

4. The beverage dispensing system of claim 1, wherein the mixing valve is continuously adjustable to control the concentration of concentrate in the beverage.

5. The beverage dispensing system of claim 1, wherein the pump is positioned upstream of the mixing valve.

6. The beverage dispensing system of claim 1, further comprising a receptacle coupled to the housing, shaped to mate with a portion of the concentrate source, and fluidly coupled to the fluid line to establish fluid communication between the concentrate source and the fluid line.

7. The beverage dispensing system of claim 6, further comprising:

a membrane coupled to an opening of the concentrate source;

a tube positioned to pierce the membrane upon connection of the concentrate source to the receptacle to establish fluid communication between the concentrate source and the fluid line.

8. The beverage dispensing system of claim 6, wherein the receptacle includes a tube having:

a first inner fluid line that fluidly couples the concentrate source and an air source, and a second outer fluid line that fluidly couples the concentrate source and the fluid line.

9. The beverage dispensing system of claim 1, further comprising:

a label removably coupled to the concentrate source and including beverage identifying information, the label adapted to be coupled to the housing to display the beverage identifying information.

10. The beverage dispensing system of claim 1, wherein the second fluid line fluidly couples the water source directly to the second dispensing outlet to allow water to flow directly from the water source to the second dispensing outlet without mixing with the concentrate.

11. The beverage dispensing system of claim 1, further comprising a dispense control valve in fluid communication with the first fluid line, the dispense control valve having an open position, in which water is allowed to flow in the first fluid line to the first dispensing outlet, and a closed position, in which water is inhibited from flowing in the first fluid line to the first dispensing outlet.

12. The beverage dispensing system of claim 1, further comprising a dispense control valve and a user-manipulatable control coupled to the housing and in electrical communication with at least one of the pump and the dispense control valve to control the flow of water in at least one of the first fluid line and the second fluid line.

13. The beverage dispensing system of claim 1, wherein at least a portion of the first fluid line is refrigerated.

14. The beverage dispensing system of claim 1, wherein the mixing valve is adjustable to permit adjustment of beverage concentration during use of the beverage dispensing system.

15. The beverage dispensing system of claim 1, further comprising a second concentrate source and a second mixing valve positioned between the pump and the second concentrate source, the second mixing valve operable to adjust the flow rate of concentrate through the second fluid line to thereby adjust the concentration of the beverage flowing out of the second dispensing outlet.

16. The beverage dispensing system of claim 1, wherein the pump is a variable pump operable to move water at any of a plurality of water flow rates, and wherein a water flow rate at least partially determines a concentrate flow rate.

17. A beverage dispensing system for dispensing a beverage comprising water from a water source, the beverage system comprising:

a housing;

a single inlet adapted to be coupled to the water source to supply water at a volumetric flow rate;

a portable and removable concentrate source adapted to retain concentrate to be dispensed by the beverage dispensing system;

a first dispensing outlet from which a first fluid comprising at least one of water and concentrate is dispensed from the beverage dispensing system;

a second dispensing outlet from which a second fluid comprising at least one of water and a concentrate is dispensed from the beverage dispensing system, wherein the second fluid is different from the first fluid;

a first fluid line fluidly coupling the water source and the first dispensing outlet;

a second fluid line fluidly coupling the water source and the second dispensing outlet;

a pump in fluid communication between the inlet and the first fluid line and between the inlet and the second fluid line, the pump being operable to move water from the water source toward the first dispensing outlet, the pump being operable to move water from the water source toward the second dispensing outlet; and a mixing valve positioned in the first fluid line fluidly connecting the concentrate source and the first fluid line to supply any desired amount of concentrate in a range of concentrate amounts from the concentrate source to the first fluid line, wherein the range of concentrate amounts correspond to a range of water amounts flowing through the first fluid line to produce a corresponding range of beverage amounts dispensed from the first dispensing outlet.

18. The beverage dispensing system of claim 17, wherein the range of beverage amounts dispensed from the first dispensing outlet have a substantially constant concentration of concentrate.

19. The beverage dispensing system of claim 17, wherein the mixing valve is continuously adjustable to control the amount of concentrate supplied from the concentrate source to the first fluid line.

20. The beverage dispensing system of claim 17, wherein the water source comprises a faucet fluidly coupled to an external water supply.

21. The beverage dispensing system of claim 17, wherein the mixing valve comprises a Venturi valve.

22. The beverage dispensing system of claim 17, further comprising a dispense control valve in fluid communication with the first fluid line, the dispense control valve having an open position, in which at least one of water and concentrate is allowed to flow past the dispense control valve in the first fluid line toward the first dispensing outlet, and a closed position, inhibiting flow past the dispense control valve.

23. The beverage dispensing system of claim 22, further comprising a user-manipulatable control coupled to the housing and in electrical communication with the dispense control valve to move the dispense control valve between the open position and the closed position based on a signal received by the dispense control valve from the user-manipulatable control.

24. The beverage dispensing system of claim 17, further comprising a receptacle coupled to the housing, shaped to mate with a portion of the concentrate source, and fluidly coupled to the first fluid line to establish fluid communication between the concentrate source and the first fluid line.

25. The beverage dispensing system of claim 24, further comprising:

a cap having a membrane coupled to an opening of the concentrate source; and a tube positioned to pierce the membrane upon connection of the concentrate source to the receptacle to establish fluid communication between the concentrate source and the first fluid line.

26. The beverage dispensing system of claim 17, wherein at least a portion of the first fluid line is refrigerated.

27. A method for dispensing a beverage, the method comprising:

providing a water source for supplying water;

providing a concentrate source for supplying concentrate;

moving water from the water source through a single inlet toward a first dispensing outlet via a first fluid line by a pump in fluid communication with the first fluid line, the pump moving the water at a volumetric flow rate;

moving water from the water source through the single inlet toward a second dispensing outlet via a second fluid line by the pump in fluid communication with the second fluid line;

moving concentrate from the concentrate source to the first fluid line by the pump via a mixing valve, the mixing valve positioned to supply an amount of concentrate to the first fluid line based on the volumetric flow rate of the water in the first fluid line and a desired concentration of concentrate in the beverage to be dispensed;

mixing water and concentrate in the mixing valve; and controlling the volumetric flow rate of the water with a dispense controlling valve positioned between the pump and the mixing valve.

* * * * *